United States Patent [19]

Oya

[11] 4,381,689

[45] May 3, 1983

[54] CHORD GENERATING APPARATUS OF AN ELECTRONIC MUSICAL INSTRUMENT

[75] Inventor: Akiyoshi Oya, Hamamatsu, Japan

[73] Assignee: Nippon Gakki Seizo Kabushiki Kaisha, Hamamatsu, Japan

[21] Appl. No.: 313,471

[22] Filed: Oct. 21, 1981

[30] Foreign Application Priority Data

Oct. 28, 1980 [JP] Japan ..... 55-150055

[51] Int. Cl.[3] ..... G10H 1/38; G10H 7/00

[52] U.S. Cl. ..... 84/1.01; 84/DIG. 2; 84/DIG. 22

[58] Field of Search ..... 84/1.01, 1.03, DIG. 2, 84/DIG. 22

[56] References Cited

U.S. PATENT DOCUMENTS

| | | | |
|---|---|---|---|
| 4,282,786 | 8/1981 | Deutsch et al. | 84/1.01 |
| 4,295,402 | 10/1981 | Deutsch et al. | 84/1.03 |
| 4,315,451 | 2/1982 | Uchiyama et al. | 84/1.03 |
| 4,327,622 | 5/1982 | Aoki | 84/1.03 |
| 4,336,735 | 6/1982 | Amano et al. | 84/DIG. 22 |

*Primary Examiner*—S. J. Witkowski

*Attorney, Agent, or Firm*—Spensley, Horn, Jubas & Lubitz

[57] ABSTRACT

A root note detection circuit detects the highest or lowest key among depressed keys in an accompaniment key range as a root note designation key. A root note memory stores the detected root note data and rewrites its storage each time the detected root note data changes. A chord type detection circuit detects a chord type in accordance with states of depression of keys other than the detected root note designation key in the accompaniment key range. The detected chord type data is stored in a chord type memory by being controlled by outputs of a root note change memory and a new key detection circuit. The root note change memory detects change in the root note by comparing the output of the root note detection circuit with the output of the root note memory and outputs a root note change signal during a preset waiting timing. Accordingly, the data stored in the chord type memory can be rewritten not only upon detection of depression of a new key but during this waiting time. False chord type data which is temporarily detected when the root note designation key is changed in a legato style ceases to be detected within this waiting time so that correct data is finally stored in the memory. A chord is determined by the root note data and the chord type data stored in these memories.

11 Claims, 10 Drawing Figures

CHORD GENERATING APPARATUS OF AN ELECTRONIC MUSICAL INSTRUMENT

BACKGROUND OF THE INVENTION

This invention relates to a chord generating apparatus of an electronic musical instrument capable of producing a musical tone relating to a chord by designating a root note and a chord type.

Known in the prior art electronic musical instrument is a chord designation device in a single finger mode in an automatic bass chord performance according to a chord determined by combination of a root note and a chord type. For designating a chord by this prior art device, there have been practiced the following two methods. One is to depress, in an electronic musical instrument having an upper keyboard, a lower keyboard and a pedal keyboard, a key in the lower keyboard corresponding to a selected root note and depress (or not depress) a black key or a white key in the pedal keyboard for designating a chord type such as minor, seventh and major. The other method is to depress a key in a keyboard (e.g. the lower keyboard) corresponding to a selected root note and designate a chord type such as major, minor and seventh by operating a switch (e.g. a touch bar type switch) provided specially for designation of a chord type.

The former method, however, is disadvantageous in that it is inapplicable to an electronic musical instrument having only one or two keyboards (i.e. having no pedal keyboard). Besides, even in an electronic musical instrument having three keyboards, the pedal keyboard cannot be used for selectively sounding bass tones while the pedal keyboard is being used for designation of a chord type. The latter method is disadvantageous in that it poses problems of increase in a cost of manufacture and an extra space due to the necessity of providing the special switch for exclusive purpose of designating a chord type. Besides, performance becomes difficult because the performer must play both the keyboard (for designating a root note) and the separately provided switch (for designating a chord type) together.

For overcoming the above described disadvantages, the specification of the U.S. patent application Ser. No. 228,885 entitled "A chord generating apparatus of electronic musical instrument" filed Jan. 27, 1981, and now U.S. Pat. No. 4,353,278 discloses an art of designating both a root note and a chord type by using keys in the same keyboard. According to this device, a key corresponding to a desired root note is depressed as the highest (or lowest) note and another key in the same keyboard (or the same key range) is depressed for designating a desired chord type (major, minor, seventh and the like). By using keys in the same keyboard (or the same key range) for designating both a root note and a chord type, a special switch exclusively used for designating a chord type is obviated and the performance is facilitated. In this device, however, change in a chord is effected by depressing new chord designation keys (i.e., root note designation key and chord type designation key) after completely releasing key which have been depressed until then. If, accordingly, the root note designation key is changed in a legato style, a chord which the performer has not intended is erroneously detected with a result that automatic accompaniment tones (chord tones, automatic bass tones and automatic arpeggio tones) are sounded on the basis of the false chord.

More specifically, in the above described device described in the prior U.S. patent, data corresponding to a root note designation key and a chord type designation key are respectively loaded in a root note memory and a chord type memory only when any new key is depressed in a keyboard (or a key range) allotted to designation of a chord, and chord tones and other automatic accompaniment tones are produced on the basis of the data stored in these memories. For this reason, the following inconvenience occurs in case the root note designation key is changed in a legato style. If, for example, the highest note key among depressed keys is selected as the root note designation key and this root note designation key is changed from the high note to lower notes in a legato style, the old root note designation key has not been released yet in an initial stage of depression of the new root note designation key so that the old root note designation key on the high note side is temporarily detected as the root note designation key whereas the new root note designation key on the low note side is detected as the chord type designation key. Accordingly, the old root note designation key is stored in the root note memory in response to initiation of depression of the new root note designation key and the new root note designation key is stored in the chord type memory and held therein. As a result, automatic accompaniment tones which the performer has not intended to play are produced on the basis of the data stored in these memories. Similar inconvenience occurs if the root note is changed from a low note to high notes in a legato style. In this case, a new root note designation key depressed on the high note side is correctly stored in the root note memory in response to initiation of depression of the new root note designation key. In the chord type memory, however, an old root note designation key which is still being depressed (i.e., has not been completely released) on the low note side is erroneously stored and held thereafter. As a result, accompaniment tones which the performer has not intended to play are produced on the basis of the data stored in these memories.

SUMMARY OF THE INVENTION

It is, therefore, an object of the present invention to eliminate the above described disadvantage occuring in case the root note designation key has been changed in legato style in the prior art chord generating apparatus of a type wherein key operations for selecting a root note and a chord type are individually made by using the same keyboard (or the same key range) and a chord is determined by combination of the selected root note and chord type. This object is achieved by providing, in a chord generating apparatus of an electronic musical instrument comprising a root note memory storing a root note and a chord type memory storing a chord type and producing tones relating to a chord on the basis of data stored in these memories, root note change detection means for detecting change in the root note for outputting a root note change signal during a waiting time in accordance with this detection and new key detection means for detecting depression of a new key for outputting a new key detection signal in accordance with this detection, controlling loading of chord type data in the chord type memory by the root note change signal and the new key detection signal and controlling loading of root note data in the root note memory in response to detection of depression of the new key. If the root note designation key has been changed in a legato style, the old root note designation key is maintained during the waiting time during which the root note change signal is being outputted whereby key depression in the keyboard maintains a state in which correct root note and chord type which the performer intends to play are designated. Accordingly, by controlling the chord type memory by the root note change signal being generated during the waiting time, correct chord type data is finally stored in the chord type memory upon elapsing of the waiting time. In a case where the root note has not been changed but the chord type only has been changed, the chord type memory is controlled by the new key detection signal so that correct chord type data can be stored in the chord type memory. Since root note data is stored in the root note memory in response to detection of a new root note without imposing restriction that root note data should be stored in response only to new key depression, new root note data is stored in the root note memory each time a root note designation key is changed in a legato style and holding of storage of a false root note which the performer has not intended to play can be prevented. The root note memory may be so constructed that contents stored therein are rewritten each time the root note detection data detected by the root note detection means changes. The root note memory may also be constructed, as in the chord type memory, such that contents thereof are rewritten in response to the root note change memory and the new key detection signal. In this latter case, the contents of the memory are also rewritten in response to change in the root note detection data.

It is another object of the invention to substantially prohibit change in the chord type during sounding of automatic accompaniment tones so as to prevent changing of the note of the automatic accompaniment tones during sounding thereof. For this purpose, in producing an automatic accompaniment tone relating to a chord, the waiting time should preferably be an interval of time until arrival of a next sounding timing of the automatic accompaniment tone instead of a constant waiting time. Since change in contents stored in the chord type memory is restricted after ending of the waiting time, the inconvenience that the chord type is changed during sounding of the automatic accompaniment tone can be prevented by ending the waiting time immediately before the sounding of the automatic accompaniment tone. For this purpose an arrangement may be made such that, for example, the root note change signal is stored in the root note change detection means and this storage is cleared by the automatic accompaniment tone sounding timing signal.

It is still another object of the invention to prevent detection of a false root note occurring due to irregularity in release timing when a plurality of depressed keys are released at the same time. For this purpose, the apparatus includes new key-off detection means for detecting release of any key and means for temporarily prohibit detection of the root note change by the root note change detection means.

BRIEF DESCRIPTION OF THE DRAWINGS

In the accompanying drawings.

DESCRIPTION OF PREFERRED EMBODIMENTS

Figure 1:
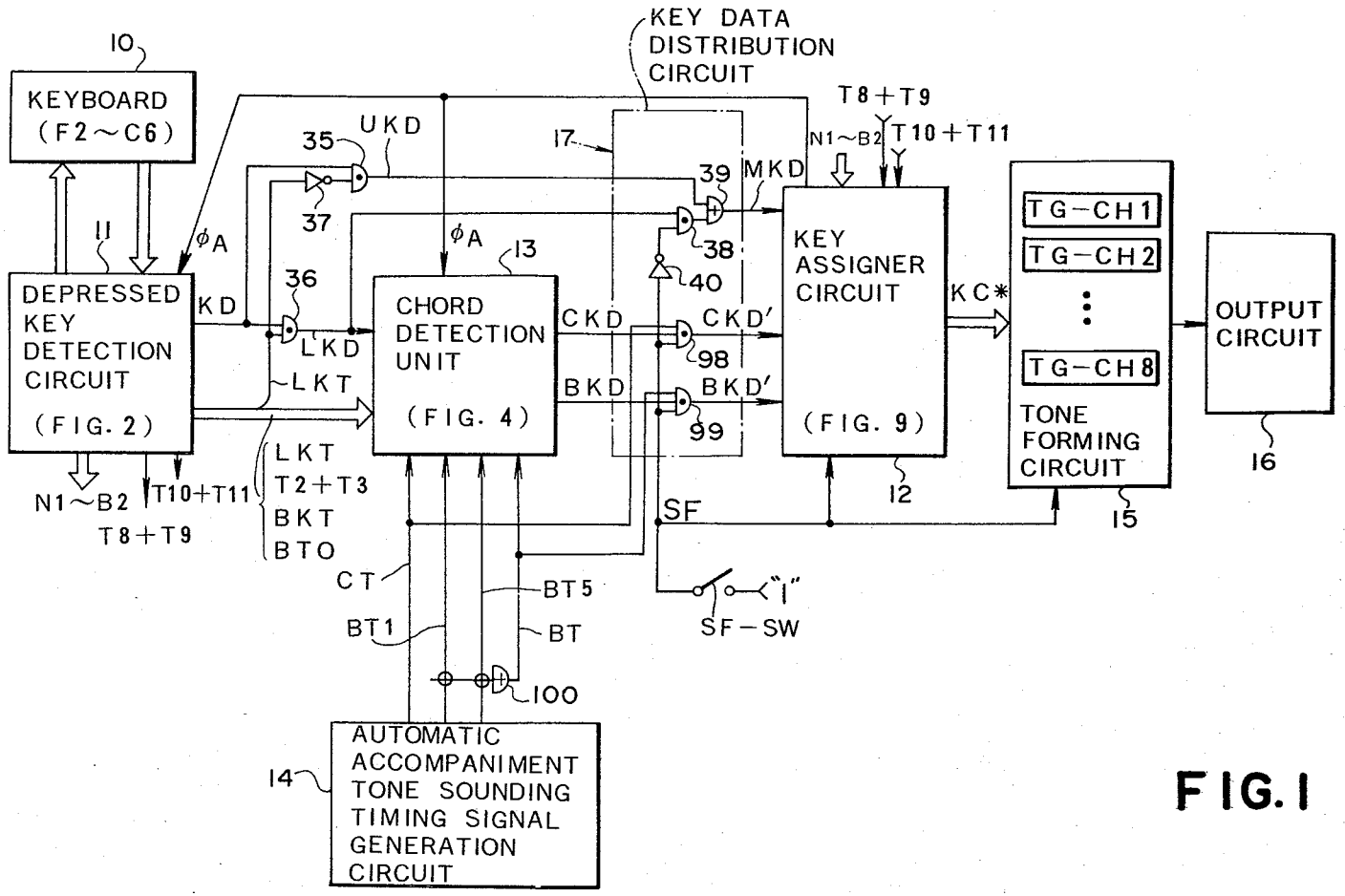
FIG. 1 is a block diagram showing an overall construction of an embodiment of the electronic musical instrument made according to the present invention.

An electronic musical instrument shown in FIG. 1 is of a type having a single stage keyboard 10. The keyboard 10 in this embodiment comprises 44 keys ranging from F2 to C6. This electronic musical instrument is so constructed that, if the automatic accompaniment function has been selected, a musical tone having a tone color for melody is produced in response to depression of a key in a high key range in the keyboard 10 (e.g., 30 keys from G3 to C6) and a musical tone for accompaniment is also produced in response to depression of a key in a low key range including the rest of keys (e.g., 14 keys from F2 to F#3), whereas if the automatic accompaniment function has not been selected, a musical tone for melody is produced in response to depression of a key in the entire key range in the keyboard 10. While there are variety of automatic accompaniment functions, an automatic accompaniment function by a single finger mode only is shown in the present embodiment. Since the single finger mode only among the various automatic accompaniment functions relates to the subject matter of the present invention, other automatic accompaniment functions are omitted for brevity of explanation. A depressed key detection circuit 11 scans keys in the keyboard 10 sequentially from a highest note side in response to a scanning clock pulse $\phi_A$ to identify the respective keys by their chronological positions or time slots measured from a certain reference time point in the key scanning operation and outputs, on a single output line, time division multiplexed key data KD representing depression or release of a key in accordance with presence or absence of a pulse at a time slot to which the key is assigned. The circuit 11 includes a counter for scanning of the keys and provides a key assigner circuit 12 with a key code of plural bit (consisting of a note code N1–N4 and an octave code B1, B2) which represents a key under scanning. In the circuit 11 there is provided a spare scanning time which does not correspond to any key in the keyboard 10 and during which no key data KD is delivered out so that time allowance is provided in post-stage circuits for generating or assigning various key information required for the automatic accompaniment. Further, the circuit 11 produces various timing signals relating to the key scanning and supplies these timing signals to other circuits.

A chord detection unit 13 detects a root note and type of a chord on the basis of a key which has been depressed in an accompaniment key range in the keyboard 10 and, in accordance with this detection, outputs data (chord key data CKD) representing notes constituting the detected chord and also data (bass tone key data BKD) representing a note of a bass tone in accordance with detection of the chord and bass generation timing signals BT1 and BT5. As the accompaniment key range, the above described low key range (the 14 keys from F2 to F#3) is utilized. Designation of a chord in accordance with the invention is effected by depressing a key corresponding to a desired root note as an endmost note in the accompaniment key range and designating the type of chord by a key other than the one for the endmost note in the accompaniment key range. The "endmost note" herein means the highest note or the lowest note in the accompaniment key range. In the present embodiment, a key for designating a root note is depressed as the highest note in the accompaniment key range. In the present embodiment, the type of chord is designated by depressing any white or black key in the accompaniment key range other than the key of the highest note used for designating a root note or without depressing any key at all. If no key other than the root note designating key (i.e. the highest note key) is depressed in the accompaniment key range, a major chord is designated. If any black key is depressed, a minor chord is depressed. If any white key is depressed, a seventh chord is designated. It should be noted that the chord detection unit 13 comprises some devices which characterize the present invention, which will be fully described later.

An automatic accompaniment tone sounding timing signal generation circuit 14 generates signals representing timing of sounding various automatic accompaniment tones. For this circuit, known circuits employed in known automatic performance devices such as an automatic bass chord performance device, an automatic rhythm performance device or an automatic arpeggio performance device may be utilized with or without modification. In the present embodiment, bass tones of prime and fifth degree only are generated as automatic bass tones. Bass tone sounding timing signal BT1 generated by the circuit 14 consists of a train of pulses which are generated at a timing for sounding the prime bass tone whereas bass tone sounding timing signal BT5 consists of a train of pulses which are generated at a timing for sounding the fifth degree bass tone. The circuit 14 also produces a chord sounding timing signal CT consisting of a train of pulses which are generated at a timing for sounding a chord.

A tone forming circuit 15 consists of tone generators TG-CH1 through TG-CH8 for eight channels. Any tone generators of known or novel construction may be used for this circuit 15. The key assigner circuit 12 is a circuit provided for assigning a tone of a key depressed in the keyboard 10 for automatic accompaniment tones (i.e., tone constituting chord band bass tones) to either of these channels. Key codes KC* representing tones (or a depressed key) assigned to these channels are provided by the key assigner circuit 12 to the tone forming circuit 15. Each of the tone generators TG-CH1 through TG-CH8 corresponding to the respective channels forms a tone signal of a pitch corresponding to the key code KC* assigned to the specific channel, providing such tone signal with a tone color for melody, a chord tone or a bass tone. Tone signals formed in the tone generators TG-CH1 through TG-CH8 are supplied to an output circuit 16 for sounding of the tones. The output circuit 16 comprises a sound system and circuits for creating various musical effects according to necessity (e.g., an expression circuit).

A mode of utilizing the respective channels is changed as shown in Table 1 depending upon whether or not the automatic accompaniment function, i.e., the single finger mode function, has been selected. A single finger mode selection switch SF-SW is provided for selecting the single finger mode and an output signal SF of this switch SF-SW is applied to the key assigner circuit 12, the tone forming circuit 15 and a key data distribution circuit 17.

TABLE 1

| | SF | $\overline{SF}$ |
|---|---|---|
| Channel group for melody | CH1, CH2, CH3, CH4 (KD of keys G3 - C6) | CH - CH8 (KD of keys F2 - C6) |
| Channel group for chord | CH5, CH6, CH7 (CKD) | — |
| Channel group for bass | CH8 (BKD) | — |

In Table 1, SF represents a case where the single finger mode has been selected (i.e., the single finger mode signal SF is "1") $\overline{SF}$ represents a case where the single finger mode is not selected (i.e., the single finger mode signal SF is "0"). The "channel group for melody" includes channels for which the tone color for melody is provided. The "channel group for chord" includes channels for which the tone color for chord tones is provided. The "channel group for bass" includes a channel for which the tone color for bass tones is provided. Reference characters CH1 through CH8 designates channels corresponding to the tone generators TG-CH1 through TG-CH8. Indications in parenthesis under the indications of channels CH1–CH8 in Table 1 represents kinds of key data which are to be assinged to the respective channels in the case SF or $\overline{SF}$. A key data distribution circuit 17 distributes key data to be assinged to the respective channels according to the case SF or $\overline{SF}$.

In a case where the single finger mode has been selected, the column of SF in the Table 1 is applied. Key data KD of the keys G3–C6 (hereinafter called "key range for melody") are distributed to the channel group for melody by the key data distribution circuit 17 and tones corresponding to the depressed keys which are designated by these key data KD are assigned to either of the channels CH1, CH2, CH3, and CH4 in the key assigner circuit 12. A tone color formed in the tone generators TG-CH1 through TG-CH4 corresponding to these channels CH1 through CH4 constitutes a tone color for melody. Chord tone key data CKD outputted by the chord detection unit 13 are distributed by the key data distribution circuit 17 to the channel group for chord and tones designated by these key data CKD are assigned to either of the channels CH5, CH6 and CH7 in the key assinger circuit 12. A tone color formed in the tone generators TG-CH5 through TG-CH7 corresponding to the channels CH5–CH7 constitutes a tone color for chord. Bass tone key data BKD outputted from the chord detection circuit 13 is distributed by the key data distribution circuit 17 to the channel group for bass and a tone designated by the key data BKD is assigned to the channel CH8 in the key assigner circuit 12. A tone color formed in the tone generator TG-CH8 corresponding to the channel CH8 constitutes a tone color for bass.

In a case where the single finger mode is not selected, the column of $\overline{SF}$ in the Table 1 is applied. Key data KD of all keys F2–C6 are distributed by the key data distribution circuit 17 to the channel group for melody and all of the channels CH1–CH8 are included in the channel group for melody in this case. Accordingly, the key assigner circuit 12 assigns tones designated by key data KD of the keys F2–C6 to either of the channels CH1 through CH8 and a tone signal for a tone color for melody is formed in all of the tone generators TG-CH1 through TG-CH8.

In the above described manner, the mode of utilizing the respective channels is switched in accordance with the state of the single finger mode signal SF (i.e., "1" or "0") in the key assigner circuit 12, the tone forming circuit 14 (tone generators TG-CH1 through TG-CH8) and the key data distribution circuit 17.

Examples of the circuit portions in FIG. 1 will now be described in detail.

Figure 2:
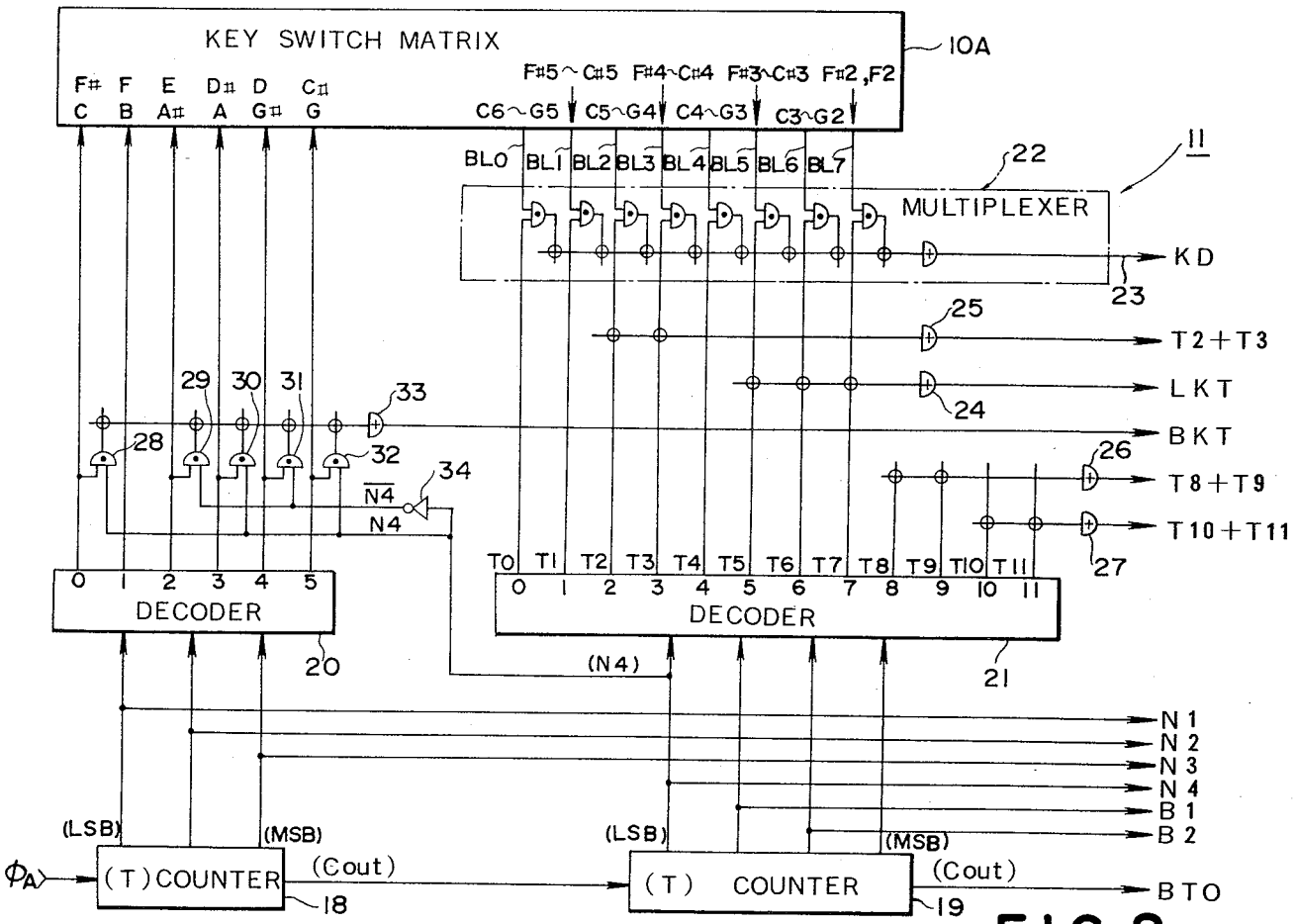
FIG. 2 is a block diagram showing in detail an example of a key depression detection circuit in FIG. 1.

Referring to FIG. 2, an example of the depressed key detection circuit 11 will first be described. There are provided key scanning counters consisting of a counter 18 of modulo 6 which counts a scanning clock pulse $\phi_A$ and a counter 19 of modulo 12 which counts a carry out signal (Cout) of the counter 18. The scanning clock pulse $\phi_A$ is provided by a timing signal generation circuit in the key assigner circuit 12 (FIG. 1) as will be described later. The output of the counter 18 is applied to a decoder 20. In response to counts of the counter 18 (i.e., "0", "1", "2", "3", or "5" in decimal notation), one of outputs "1", "2", "3", "4" or "5" of the decoder 20 is turned to "1".

A key switch matrix 10A includes a plurality of key switches corresponding to the respective keys F2–C6 in the keyboard 10 which are arranged in the form of matrix. In this key switch matrix 10A, the output "0" of the decoder 20 is applied to a line corresponding to note names C and F#. Likewise, the outputs "1", "2", "3", "4" and "5" of the decoder 20 are respectively applied to lines corresponding to notes B and F, notes A# and E, notes A and D#, notes G# and D and notes G and C#. Accordingly, each time count of the counter 18 has circulated twice in the order of "0", "1", "2", "3", "4", "5", "6", "0" . . . , 12 notes have been sequentially scanned from the highest note side in the order of notes C, B, A#, A, G#, G, F#, F . . . .

Outputs BL0–BL7 of the key switch matrix 10A correspond to groups of half octave (C6–G5, F#5–CF5, C5–G4, . . . ) among these keys C6–F2. These outputs BL0–BL7 are applied to a multiplexer 22 where they are selected by output signals T0–T7 of a decoder 21 corresponding to count "0"–"7" of the counter 19 of modulo 12 and combined on a single line 23. In the decoder 21, one of output signals T0–T11 is turned to "1" in accordance with count of the counter 19 ("0", "1", . . . "11" in decimal notation). Timings of generation of the output signals T0–T11 of the decoder 21 are hereinafter called "block timings T0–T11.

Figure 3:
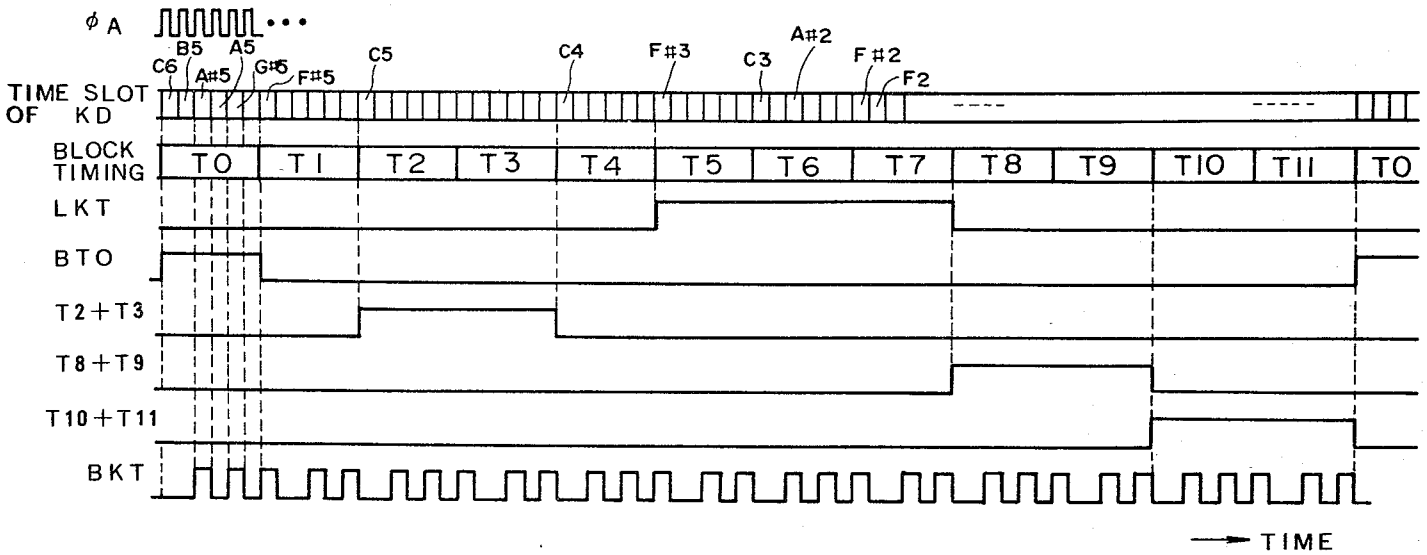
FIG. 3 is a time chart showing the operation of the circuit shown in FIG. 2.

When the count of the counter 19 is "0", the matrix output BL0 corresponding to the keys C6–G5 belonging to the highest half octave are selected in the multiplexer 22. As counting in the counter 19 proceeds thereafter, outputs BL1 . . . BL7 of lower key ranges are sequentially selected. Since the output of the decoder 20 completes one cycle starting from the highest note while the output of the decoder 21 maintains one value, all of the keys in the key switch matrix 10A are sequentially scanned from the highest note (from the highest key C6 to the lowest key F2). Accordingly, key data KD ("1" represents depression of a key and "0" release of a key) which is time division multiplexed from the highest note toward lower notes is provided on the output line 23 of the multiplexer 22. FIG. 3 shows timing of generation of the scanning clock pulse $\phi_A$, key names C6 . . . F2 assigned to respective time slots of the time division multiplexed key data KD and timings at which the outputs T0–T11 of the decoder 21 are turned to "1" (i.e., block timings). One time slot of the key data KD (i.e., time width for one key) is equivalent to one period of the clock pulse $\phi_A$. Time width of one block timing is equivalent to six time slots of the key data KD (i.e., time width for six keys).

The outputs of the counters 18 and 19 are outputted from the depressed key detection circuit 11 as a binary coded signal representing a key under scanning. I.e., a key code N1–N4, B1, B2. Three bits N1–N3 counting from the least significant bit in a note code N1–N4 which is a component of the key code are the outputs of the counter 18 and the most significant bit N4 is the output of the least significant bit of the counter 19. The scanning timing for each of 12 notes C, B, . . . C# can be identified by the 4-bit note code N1–N4. An octave code B1, B2 are the output of the second and third bits of the counter 19. The octave code B2, B1 assumes a value "00" at scanning timings for the keys C6–C#5, i.e., block timings T0 and T1, a value "01" at scanning timings for the keys C5–C#4, i.e., at block timings T2 and T3, a value "10" at scanning timing for the keys C4–C#3, i.e., at block timings T4 and T5 and a value "11" at scanning timings for the keys C3–F2, i.e., at block timings T6 and T7. It should be noted that while the octave code B1, B2 assumes a value "00" or "01" at block timings T8–T11 which do not correspond to the key scanning operation, these values of the octave code B1, B2 are not used, as will be described more fully later.

Outputs T5, T6 and T7 of the decoder 21 corresponding to the scanning timings of the keys F#3–F2 of the accompaniment key range are applied to an OR gate 24 which delivers out an accompaniment key range scanning timing signal LKT (FIG. 3). Besides, a carry out signal Cout is outputted from the counter 19 as a first block timing signal BTO (FIG. 3). This signal BTO is utilized as a signal indicating start of a new scanning cycle, i.e., completion of a preceding scanning cycle. Outputs T2 and T3 of the decoder 21 are applied to an OR gate 25 which thereupon delivers out a timing signal T2+T3 (FIG. 3) which is "1" at block timings T2 and T3. Outputs T8 and T9 of the decoder 21 are applied to an OR gate 26 which thereupon delivers out a timing signal T8+T9 (FIG. 3) which is "1" at block timings T8 and T9. Outputs T10 and T11 of the decoder 21 are applied to an OR gate 27 which thereupon delivers out a timing signal T10 and T11 (FIG. 3) which is "1" at block timings T10 and T11. And gates 28, 29, 30, 31 and 32 reveive, at one input thereof, outputs "0", "2" "3", "4" and "5" of the decoder 20 respectively. The AND gate 28, 30 and 32 receive, at the other inputs thereof, the outputs of the least significant bit of the counter 19 (i.e., the most significant bit data N4 of the note code). The AND gates 29 and 31 receive, at the other input thereof, a signal obtained by inverting the least significant bit output of the counter 19 by an inverter 34. Outputs of the AND gates 28 through 32 are applied to an OR gate 33 which thereupon delivers out a block key scanning timing signal BKT (FIG. 3). The output of the least significant bit of the counter 19 (i.e., N4) is "0" at block timings T0, T2, T4, T6, T8 and T10 and "1" at block timings T1, T3, T5, T7, T9 and T11.

Notes of keys which are scanned at the block timings T0, T2, T4, T6, T8 and T10 are C, B, A#, A, G# and G. At these block timings, the outputs "2" and "4" of the decoder 20 are selected through the AND gates 29 and 31 which are enabled by the output "1" of the inverter 34 and the black key scanning timing signal BKT becomes "1" in synchronism with the scanning timings for black key notes A# and G#. Notes of keys which are scanned at the block timings T1, T3, T5, T7, T9 and T11 are F#, F, E, D#, D, C#. At these block timings, the outputs "0", "3" and "5" of the decoder 20 are selected through the AND gates 28, 30 and 32 which are enabled at these timings and the signal BKT becomes "1" in synchronism with the scanning timings of black key notes F#, D# and C#. This black key scanning timing signal BKT is utilized in the chord detection unit 13 (FIG. 1) for judging whether a black key or a white key is being depressed as a chord type designation key.

Figure 4:
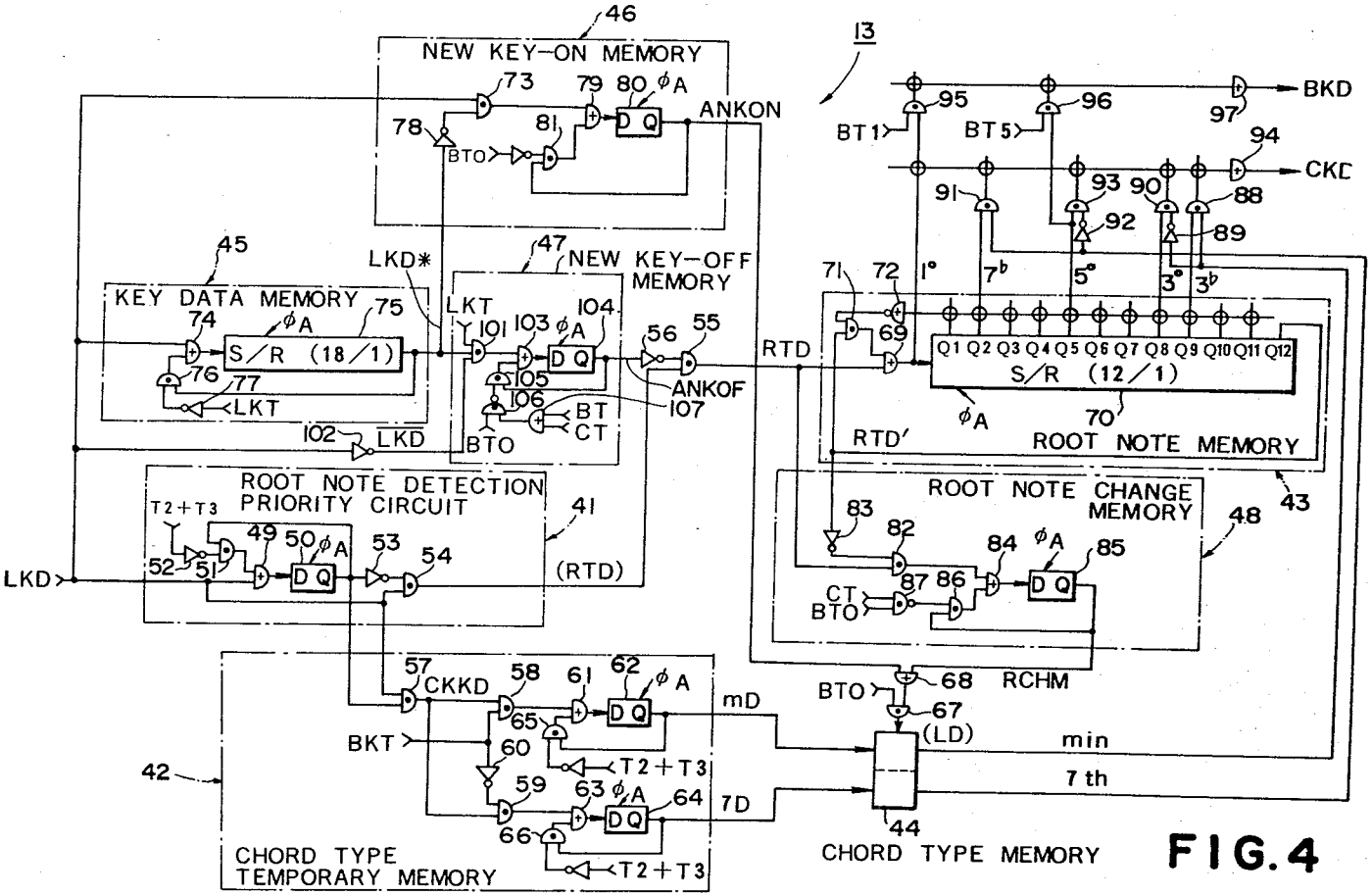
FIG. 4 is a circuit diagram showing in detail an example of a chord detection unit in FIG. 1.

The key data KD outputted by the depressed key detection circuit 11 (FIG. 2) is supplied to AND gates 35 and 36 shown in FIG. 1. On the other hand, the timing signals LKT, T2+T3, BKT and BTO are supplied to the chord detection unit 13 (FIGS. 1 and 4). The timing signals T8+T9 and T10+T11 and the key code N1−B2 are supplied to the key assigner circuit 12 (FIG. 1).

An accompaniment key range scanning timing signal LKT is applied to the other input of the AND gate 36 (FIG. 1) and also is applied to the other input of the AND gate 35 after being inverted by an inverter 37. Accordingly, key data KD of keys in the accompaniment key range, i.e., keys F#3 through F2 are selected by the AND gate 36 whereas key data KD of keys belonging to a key range which is higher than the accompaniment key range, i.e. keys C6 through G3 are selected by the AND gate 35. The key data KD which has been selected by the AND gate 36 is supplied to the chord detection unit 13 as the accompaniment key range key data LKD and also to an AND gate 38 in the key data distribution circuit 17. The key data KD which has been selected by the AND gate 35 is supplied to an OR gate 39 in the key data distribution circuit 17 as high key range key data UKD. The AND gate 38 receives, at the other input thereof, a signal obtained by inverting the single finger mode signal SF by an inverter 40 and provides its outputs to the OR gate 39. The output of the OR gate 39 is supplied to the key assigner circuit 12 as melody key data MKD. By the above described arrangement, distribution of key data to be assinged to the channel group for melody such as shown in the Table 1 is controlled in response to the single finger mode signal SF. If the single finger mode signal SF is "1", the AND gate 38 is disabled and the high key range key data UKD corresponding to the keys C6–G3 only constitutes the melody key data MKD, whereas if the single finger mode signal SF is "0" (i.e., in the case of $\overline{SF}$), the AND gate 38 is enabled and the high key range key data UKD and the accompaniment key range key data LKD (i.e., key data KD of all of the keys C6–F2) both constitute the melody key data MKD.

An example of the chord detection unit 13 will now be described in detail with reference to FIG. 4. The chord detection unit 13 performs detection of a root note and a type of chord on the basis of the accompaniment key range key data LKD provided by the AND gate 36 in FIG. 1. The chord detection unit 13 is constructed in such manner that it will satisfy the following seven requirements:

Requirement (1): To detect the highest key being depressed at the present moment in the accompaniment key range as a root note designation key.

Requirement (2): To detect a type of chord in accordance with a state of depression of keys other than the root note designation key in the accompaniment key range (whether a white key or a black key is being depressed or no key is being depressed).

Requirement (3): To store a note name of the root note designation key which has been detected according to the above Requirement (1): The note stored herein is used as correct root note data.

Requirement (4): To store the type of chord which has been detected according to the Requirement (2). The type of chord stored herein is used as correct chord type data.

Requirement (5): In principle, the root note which has been detected according to the Requirement (1) should be stored unconditionally in the Requirement (3) and the root note name should be immediately rewritten if the detected root note has changed.

Requirement (6): If any new key has been depressed in the accompaniment key range (hereinafter sometimes called "any new key-on") or if the root note which has been detected according to the Requirement (1) is different from the root note which is stored according to the Requirement (3), i.e., the root note has been changed, the storage of the type of chord in the Requirement (4) should be rewritten within a period of time from such any new key-on or change of the root note till a certain change waiting time has elapsed.

Requirement (7): For preventing detection of a false root note designation key according to the Requirement (1) upon release of a key, the detection of the root note designation key according to the Requirement (1) should be prohibited during a period of time from a time point at which any key has been newly released in the accompaniment key range (hereinafter sometimes called "any new key-off") till a certain key-off waiting time has elasped.

A root note detection priority circuit 41 is provided for implementing the detection according to the Requirement (1). A chord type temporary memory 42 is provided for implementing the detection according to the Requirement (2). A root note memory 43 is provided for implementing the storage according to the Requirement (3). A chord type memory 44 is provided for implementing the requirement (4). A key data memory 45 and a new key-on memory 46 are provided for detecting any new key-on in the Requirement (6). The key data memory 45 and a new key-off memory 47 function to detect any new key-off in the Requirement (7) and set a proper key-off waiting time upon detection of any new key-off. A root note change memory 48 is provided for detecting change of the root note in the Requirement (6) and set a proper change waiting time upon detection of the change of the root note.

The above Requirements (5) and (6) contribute to causing correct root note and chord type to be stored in the memories 43 and 44 in case the depressed root note designation key has been changed in a legato style.

In the root note detection priority circuit 41, the accompaniment key range key data LKD is applied to a delay flip-flop 50 through an OR gate 49. The delay flip-flop 50 is driven by the scanning clock pulse $\phi_A$ and outputs the applied key data LKD after delaying it by one key time ("key time" herein means one cycle of the clock pulse $\phi_A$). Incidentally, all delay flip-flops and shift registers in FIG. 4 are driven by the scanning clock pulse $\phi_A$. The output of the delay flip-flop 50 is self-held through an AND gate 51 and the OR gate 49. The AND gate 51 receives, at the other input thereof, a signal obtained by inverting the timing signal T2+T3 (FIG. 3) provided by the depressed key detection circuit 11 (FIG. 2) by an inverter 52. The root note detection priority circuit 41 detects a note of the root note designation key being depressed as the highest depressed key by preferentially detecting a first coming note timing which becomes "1" among the accompaniment key range key data LKD for one scanning cycle. The term "note timing" is employed to mean a scanning timing of the respective notes C, B, . . . C# with octaves being disregarded. As will be apparent from the time slots of the key data KD shown in FIG. 3, the note timing for the same note repeates every 12 time slots (i.e., 12 key times). Since the key scanning is performed from the highest note side, a key scanning timing which becomes "1" first represents the highest depressed key.

The timing signal T2+T3 is generated at the block timings T2 and T3 before the accompaniment key range scanning timing. Upon turning of the signal T2+T3 to "1", the AND gate 51 is disabled and the self-holding in the delay flip-flop 50 is cleared. Accordingly, the state of the delay flip-flop 50 is cleared to "0" before starting of the accompaniment key range scanning timing. Thus, the accompaniment key range key data LKD is "0" and the state of the delay flip-flop 50 is also "0" before the key scanning timing for the highest depressed key in the accompaniment key range. Upon arrival of the key scanning timing of the highest depressed key, the key data LKD is turned to "1". At this time, the delay flip-flop 50 has already outputted its delayed output "0" which is a result of key scanning one key time before and the output of the inverter 53 which inverts the output of the delay flip-flop 50 has become "1". Accordingly, an AND gate 54 which receives the output of the inverter 53 and the key data LKD outputs a signal "1" when the accompaniment key range key data LKD first becomes "1" in one scanning cycle, i.e., at the scanning timing (note timing) of the highest depressed key.

Figure 5:
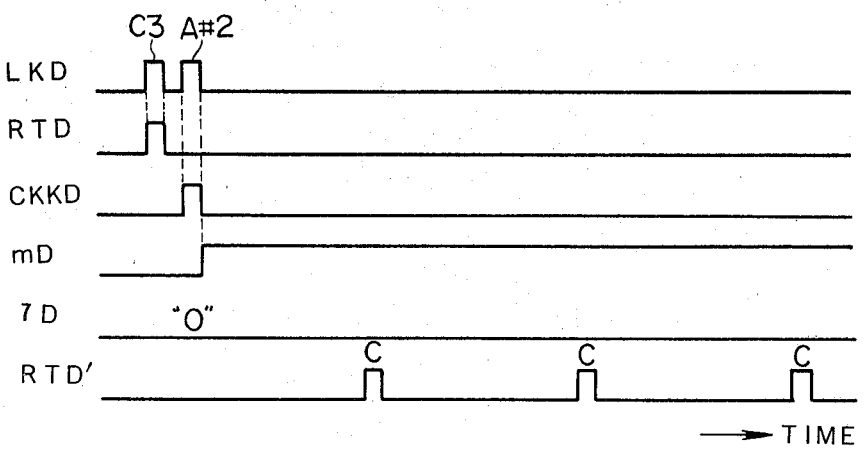
FIG. 5 is a time chart showing an example of root note detection in FIG. 4.

At a next key scanning timing of the highest depressed key, the output of the delay flip-flop 50 rises to "1" (an output obtained by delaying the key data of the highest depressed key by one key time) and this signal "1" is held by the delay flip-flop 50 until generation of the timing signal T2+T3 in a next scanning cycle. If, accordingly, the key data LKD is turned to "1" in the key scanning timing on the lower key side from the highest depressed key (i.e., in key scanning timings subsequent to the highest depressed key), the key data LKD on the lower key side is inhibited by the AND gate 54 which is receiving the output "0" of the inverter 53 which inverts the output "1" of the delay flip-flop 50. In the above described manner, the key data LKD for the highest depressed key in the accompaniment key range only is preferentially selected and outputted from the AND gate 54. The output of the AND gate 54 is applied to an AND gate 55 as data RTD representing a note timing of a chord. The AND gate 55 receives also a signal obtained by inverting by an inverter 56 an any new key-off signal ANKOF outputted by the new key-off memory 47. This output of the inverter 56 is normally "1" so that the output of the AND gate 54 is gated out of the AND gate 55 and applied to the root note memory 43 and the root note change memory 48 as root note data RTD. If, for example, a signal "1" is generated as the accompaniment key range key data LKD at scanning timings for the keys C3 and A#2 as shown in FIG. 5, the root note data RTD is turned to "1" at the timing for the key C3.

An AND gate 57 of the chord type temporary memory 42 receives the output of the delay flip-flop 50 and the accompaniment key range key data LKD. At the timing of the highest depressed key in the accompaniment key range, the output of the delay flip-flop 50 is still "0" as was previously described so that the AND gate 57 is disabled. As the output of the delay flip-flop 50 maintains "1" continuously from a next scanning time of the highest depressed key, the key data LKD for keys on the lower key side of the highest depressed key are all selected by the AND gate 57 and applied to AND gates 58 and 59 as chord type designation key data CKKD. The AND gate 58 receives at the other input thereof the black key scanning timing signal BKT (FIG. 3) provided by the depressed key detection circuit 11 (FIG. 2) whereas the AND gate 59 receives at the other input thereof a signal obtained by inverting the signal BKT by an inverter 60. Accordingly, the AND gate 58 is enabled in synchronism with the scanning timing for the black keys so that the chord type designation key data CKKD corresponding to the black keys are selected by the AND gate 58 and applied to a delay flip-flop 62 through an OR gate 61. The AND gate 59 is enabled in synchronism with the scanning timing for the white keys so that the chord type designation key data CKKD corresponding to the white keys are selected by the AND gate 59 and applied to a delay flip-flop 64 through an OR gate 63.

The outputs of the delay flip-flops 62 and 64 are self-held through AND gates 65 and 66. The AND gates 65 and 66 receive also signals obtained by inverting the timing signal T2+T3. Accordingly, the delay flip-flops 62 and 64 are cleared, as the previously described delay flip-flop 50, at a timing of the signal T2+T3 before starting of the accompaniment key range scanning timing and hold data stored during the accompaniment key range scanning timing until immediately before the block timing T2 of a next scanning cycle. If even a single black key is being depressed besides the highest depressed key in the accompaniment key range, a signal "1" is stored and held in the delay flip-flop 62. If even a single white key is being depressed besides the highest depressed key, signal "1" is stored and held in the delay flip-flop 64. At the block timing TO from which the scanning cycle starts, data representing the chord type which was detected in the preceding scanning cycle is precisely stored in the flip-flop 62 and 64.

The output of the delay flip-flop 62 is applied as a minor chord detection signal mD to the chord type memory 44. The output of the delay flip-flop 64 is applied as a seventh chord detection signal 7D to the chord type memory 44. In the example shown in FIG. 5, the chord type designation key data CKKD is turned to "1" at the timing of the black key A#2, the minor chord detection signal mD rises to "1" while the seventh chord detection signal 7D remains "0".

These minor chord detection signal mD and seventh chord detection signal 7D represent chord types detected on the basis of a present state of depression of keys other than the highest depressed key in the accompaniment key range and these chord types are not necessarily ones desired by the performer, for a state of key depression which the performer has not intended may take place in such a case as he has changed the depressed key in a legato style. For this reason, an arrangement is made in the chord type memory 44 so that continuous holding of erroneously detected signals mD and 7D can be prevented by receiving the signals mD and 7D when the Requirement (6) is satisfied.

The chord type memory 44 consists, for example, of a latch circuit of 2 bits and receives at its load control input an output of an AND gate 67. The AND gate 67 receives at one input thereof the first block timing signal BTO(FIG. 3). This is for ensuring loading of the signals mD and 7D in the memory 44 in synchronism with the block timing TO at which correct result of chord type detection (mD, 7D) for each scanning cycle are accurately outputted. The AND gate 67 receives at the other input thereof the any new key-on signal ANKON provided by the new key-on memory 46 or a root note change memory signal RCHM provided by the root note change memory 48 through an OR gate 68. This is for performing a loading operation (rewriting of stored data) in the memory 44 when the Requirement (6) has been satisfied.

Before explaining about control of storage in the chord type memory 44 on the basis of the Requirement (6), control of storage of the root note data RTD in the root note memory 43 will be described.

The root note data RTD outputted from the AND gate 55 is applied to a first stage Q1 of a shift register 70 through an OR gate 69 in the root note memory 43. The shift register 70 which is of a 12-stage-1-bit type is shift controlled by the clock pulse $\phi_A$. The root note data RTD inputted in the shift register 70 through the OR gate 69 is successively shifted every key time and data (TRD') which has been shifted by 12 key times is outputted from a twelfth stage Q12. This output RTD' of the twelfth stage A12 is fed back to the first stage Q1 through an AND gate 71 and the OR gate 69. The AND gate 71 receives at the other input thereof an output of a NOR gate 72 to which are applied all outputs of first through eleventh stages Q1–Q11 of the shift register 70.

The shift time for 12 stages, i.e., 12 key times, in the shift register 70 corresponds to one repeating cycle of a note timing of the same note in the time division multiplexed key data KD. Accordingly, at a note timing for the same note as one at whose note timing the root note data TRD is turned to "1", the output RTD' of the twelfth stage Q12 of the shift register 70 is turned to "1". At this time, the outputs of the first stage Q1 through eleventh stage Q11 of the shift register 70 are all "0" and the output of the NOR gate 72 therefore is "1". By this arrangement, the output "1" (TRD') of the twelfth stage Q12 is fed back to the first stage Q1 of the shift register 70. In this manner, the note timing of the root note data RTD (i.e., note timing representing the root note) is dynamically stored in the shift register 70 and the data TRD'(hereinafter referred to as "root note memory data") is repeatedly turned to "1" each 12 key times in synchronism with the note timing of the root note. In the example of FIG. 5, the data RTD' is repeatedly turned to "1" at a note timing of note C.

In a case where the highest depressed key in the accompaniment key range has changed, the root note data RTD is turned to "1" at a timing different from the note timing of the data RTD' stored in the root note memory 43. In this case, a signal "1" corresponding to the new root note data RTD passes through the OR gate 69 and is inputted unconditionally in the shift register 70. When the root note memory data TRD' is turned to "1" a few key times later in synchronism with the note timing of the old root note, the signal "1" of the new root note data RTD has already been inputted in any of the first stage Q1 through the eleventh stage Q11 so that the output of the NOR gate 72 is turned to "0" and the old root note memory data RTD' thereby is inhibited by the AND gate 71. By storing the new root note data RTD unconditionally and clearing the old root note memory data RTD' in the above described manner, the Requirement (5) is satisfied.

The control of storage in the chord type memory 44 is effected, as was previously described in the paragraph concerning Requirement (6), on the basis of "any new key-on" or change in the root note. Detection of new key-on is effected by storing in the key data memory 45 accompaniment key range key data LTD* in the preceding scanning cycle and comparing this stored key data LD* with the accompaniment key range key data LKD in the present scanning cycle by an AND gate 73 in the new key-on memory 46.

In the key data memory 45, the accompaniment key range key data LKD is applied to a shift register 75 through an OR gate 74. The shift register 75 is of an 18 stage-1 bit type and is capable of storing the accompaniment key range key data LKD for 14 keys (keys F#3 to F2). The output of the shift register 75 is applied to an AND gate 76. The AND gate 76 receives at the other input thereof a signal obtained by inverting the accompaniment key range scanning timing signal LKT (FIG. 3) by an inverter 77. Accordingly, at block timings T5, T6 and T7 (totalling 18 key times) corresponding to the scanning timings of the keys F#3 through F2 of the accompaniment key range, the AND gate 76 is disabled and the old storage in the shift register 75 is cleared. During this time the data of the keys F#3 through F2 in the key data LKD are stored through the shift register 75. When the data of the first key F#3 in the key data LKD is outputted from the shift register 75, the accompaniment key range scanning timing signal LKT falls to "0" and the shift register 75 enters a memory mode thereafter. The accompaniment key range key data LKD loaded in the shift register 75 thereby is circulated in the shift register 75 until arrival of the accompaniment key range scanning timing of a next scanning cycle.

This output of the shift register 75 is supplied to the new key-on memory 46 and the new key-off memory 47 as the accompaniment key range key data LKD* in the preceding scanning cycle. One scanning cycle consists of 72 key times and one circulating time of the shift register 75 is 18 key times. The data stored in the shift register 75 therefore circulates four times in one scanning cycle and, at the block timings T5, T6 and T7 at which the accompaniment key range key data LKD is generated, the key data LKD* of the preceding scanning cycle for the same keys are outputted in synchronism with the timings of the key data LKD.

The AND gate 73 in the new key-on memory 46 receives the accompaniment key range key data LKD in the present scanning cycle and a signal obtained by inverting the accompaniment key range key data LKD* in the preceding scanning cycle by an inverter 78. When a key has been newly depressed, i.e., the key data LKD* for the key in the preceding scanning cycle is "0" and the key data LKD for the key in the present scanning cycle is "1", the AND gate 73 is enabled and a signal "1" is applied from the AND gate 73 to a delay flip-flop 80 through an OR gate 79. The signal "1" applied to the delay flip-flop 80 is self-held through an AND gate 81. Since the AND gate 81 has received at the other input thereof a signal obtained by inverting the first block timing signal BTO (FIG. 3), the signal "1" stored in the delay flip-flop 80 is cleared at the beginning of a next scanning cycle (block timing TO). More specifically, the output of the delay flip-flop 80 maintains the level "1" until the first key time in the first block timing TO in a next scanning cycle (i.e., until the scanning timing of the highest key C6)' and falls to "0" from a next key time.

The output of the delay flip-flop 80 is applied to the AND gate 67 as the any new key-on signal ANKON through the OR gate 68. The AND gate 67 receives at the other input thereof the first block timing signal BTO. Accordingly, the AND gate 67 is enabled only during one key time from the rising of the first block timing signal BTO to "1" to the falling of the any new key-on signal ANKON to "0" and a signal "1" is applied to a load control input LD of the chord type memory 44 during this time. The old storage of the chord type memory 44 is thereby cleared and the minor chord detection signal mD and the seventh chord detection signal 7D being outputted by the chord type temporary memory 42 are loaded in the chord type memory 44. The fact that any key has been newly depressed in the accompaniment key range (i.e., the any new key-on signal ANKON has been generated) means that the state of the depression in the accompaniment key range has changed (i.e., the chord has changed). Accordingly, states ("1" or "0") of new minor chord detection signal mD and seventh chord detection signal 7D which have been detected according to this change in the state of key depression are stored in the chord type memory 44.

As described previously, inconvenience will arise if controls of the chord type memory 44 only are rewritten in response to a new key-on, for in case the root note designation key is changed in a legato style, false chord type detection signals (mD and 7D) are loaded in the memory 44 because the old root note designation key has not completely been released from the depressed state when the any new key-on signal ANKON has been generated in response to depression of the new root note designation key. If, for example, a key F3 has newly been depressed for designating an F major chord while a key C3 is being depressed from a state wherein the key C3 only was being depressed for designating a C major chord (i.e., the root note designation key has been changed from C3 to F3 in the legato style), a signal "1" representing the seventh chord 7D is loaded in the chord type memory 44 when the any new key-on signal ANKON has been generated in response to depression of the key F3. This is because chord type designation data CKKD is turned to "1" at the timing of the key C3 on the low key side by turning of the key data LKD to "1" at the timing of the keys F3 and C3, so that a signal "1" is temporarily stored in the delay flip-flop 64 for storage concerning white keys. Thus, if the contents stored in the chord type memory 44 are retained, there arises the inconvenience that F seventh chord is designated despite the intended designation of the F major chord. For eliminating such inconvenience, the root note change memory 48 is provided for delivering out a root note change memory signal RCHM during a certain waiting time when the root note has been changed and the contents stored in the chord type memory 44 are repeatedly rewritten in response to this signal RCHM to prevent false chord type detection signals (mD, 7D) which are only temporarily generated when the root note has been changed from being continuously stored in the memory 44.

An AND gate 82 of the root note change memory 48 receives the root note data RTD provided by the AND gate 55 and a signal obtained by inverting the root note memory data RTD' by an inverter 83. If the root note which has already been stored in the root note memory 43 is the same as the root note which has just been detected, the root note memory data RTD' is turned to "1" when the root note data RTD representing the root note which has just been detected is turned to "1" and, by turning of the output of the inverter 82 which inverts the root note memory data RTD' to "0", the AND gate 82 is not enabled. When the root note has been changed, however, the root note stored in the root note memory 43 and the root note which has been just detected do not coincide with each other so that the root note memory data RTD' is "0" when the root note data TRD is turned to "1" whereby the AND gate 82 is enabled. Accordingly, the AND gate 82 produces a signal "1" when the root note has been changed which signal "1" is held in storage through an OR gate 84, a delay flip-flop 85 and an AND gate 86. The output of the delay flip-flop 85 is applied to the AND gate 67 as the root note change memory signal RCHM through the OR gate 68.

The AND gate 86 receives at the other input thereof an output of a NAND gate 87. This NAND gate 87 in turn receives the first block timing signal BTO(FIG. 3) and a chord sounding timing signal CT provided by the automatic accompaniment tone sounding timing signal generation circuit 14. The chord sounding timing signal CT is a signal which maintains a level "1" continuously during an interval of time during which the chord is sounded. The time width of maintaining the level "1" is a relatively long one (e.g. several hundred milliseconds to several seconds) corresponding to the interval during which the chord is sounded and time width from disappearance of "1" of the signal CT to appearance of a next "1" of the same signal (i.e., time width during which the signal CT is "0") is also a relatively long one (e.g. several hundred milliseconds to several seconds) corresponding to the interval during which the chord is not sounded. When this chord sounding timing signal CT is "0" (i.e., not during the chord sounding timing) or the first block timing signal BTO is "0" (i.e., except the block timing TO in each scanning cycle), the output of the NAND gate 87 is "1" and the AND gate 86 is thereby enabled.

Since change of the chord (change of the root note) cannot normally be made during sounding of the chord, the chord sounging timing signal CT may be considered to be "0" when the root note is changed. The output "1" of the AND gate 82 representing the change of the root note, therefore, is held in the delay flip-flop 85 through the AND gate 86. Upon rising of the signal CT to "1" by arrival of the chord sounding timing, the signal BTO is turned to "1" at the block timing TO at the beginning of the scanning cycle and the output of the NAND gate 87 therefore is turned to "0". The contents stored in the delay flip-flop 85 thereby is cleared. Accordingly, the root note change memory signal RCHM outputted from the delay flip-flop 85 maintains a level "1" continuously during change waiting time which is a time interval between detection of the change of the root note and arrival of the chord sounding timing.

When the root note change memory signal RCHM is "1", the output of the AND gate 67 is repeatedly turned to "1" at the beginning of each scanning cycle (block timing TO) in response to the first block timing signal BTO and contents stored in the chord type memory 44 are repeatedly rewritten every scanning cycle. If, accordingly, false minor chord detection signal mD or false seventh chord detection signal 7D is temporarily produced during change waiting time set by the root note change memory 48, such false signal will never be held in the chord type memory 44 for more than one scanning cycle. The false detection signal mD or 7D which is only temporarily produced when the root note is changed ceases to be produced before the change waiting time set by the root note change memory 48 has elapsed (i.e., before a next chord sounding timing starts) and correct detection signals mD and 7D have been produced by that time. Accordingly, data representing a correct chord type has been loaded in the chord type memory 44 by arrival of the next chord sounding timing and this correct data is continuously stored in the memory 44.

The output of the memory 44 corresponding to the minor chord detection signal mD is applied to an AND gate 88 as minor chord data min and applied also to an AND gate 90 after being inverted by an inverter 89. The output of the memory 44 corresponding to the seventh chord detection signal 7D is applied to an AND gate 91 as seventh chord data 7th and applied also to an AND gate 93 after being inverted by an inverter 92.

Outputs of the ninth stage Q9, eighth stage Q8, fifth stage Q5 and second stage Q2 are respectively applied to the other inputs of the AND gates 88, 90, 93, and 91. Outputs of these AND gates 88, 90, 93 and 91 and an output of the OR gate 69 are applied to an OR gate 94. These AND gates 88, 90, 93 and 91 and the OR gate 94 constitute a circuit for producing data (chord key data CKD) representing note timings of notes constituting a chord in accordance with single data "1" representing a note timing of a root note circulating in the shift register 70.

The root note memory data RTD' outputted by the twelfth stage Q12 of the shift register 70 is turned to "1" at the note timing of the root note. By feeding back this data RTD' to the shift register 70 through the AND gate 71 and the OR gate 69 and delaying it successively by one by time in the respective stages Q1 through Q12, a signal "1" is successively outputted from the respective stages Q1 through Q12 at note timings shifting from one for the root note toward a low key side. Accordingly, the output "1" of the stage Q1 which has been delayed by one key time corresponds to a note timing of a note which is lower than the root note by one semitone, i.e., the major seventh. The output "1" of the stage Q2 which has been delayed by two key times corresponds to a note timing of a note which is lower than the root note by two semitones, i.e., the minor seventh (7♭). Likewise, the outputs "1" of the stages Q3, Q4, Q5, Q6, Q7, Q8, Q9, Q10 and Q11 of the shift register 70 correspond respectively to note timings of the major sixth, minor sixth, perfect fifth (5°), diminished fifth, perfect fourth, major third (3°), minor third, (3♭), major second and minor second. The output "1" of the stage Q12 i.e., the OR gate 69, corresponds to the same note as the root note, i.e., the prime (1°).

Figure 6:
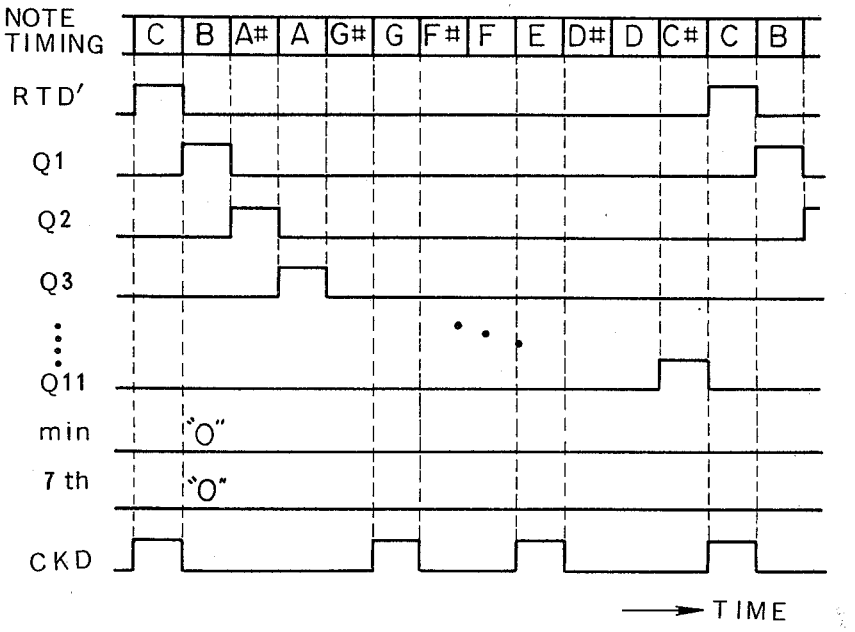
FIG. 6 is time chart showing an example of generation of chord key data CKD in FIG. 4.

If, for example, the root note memory data RTD' is turned to "1" at note timing of note C as shown in FIG. 6, it is at note timings of note B, A♯, A . . . C♯ that the outputs of the stages $Q_1$–$Q_{11}$ are turned to "1". These notes B, A♯ . . . C♯ correspond respectively to the major seventh, minor seventh (7♭) . . . minor second.

AND gates 88 and 90 are provided for selecting either the minor third (3♭) or major third (3°) in accordance with the minor chord data min. The data min is "1" in a minor chord and the output of the ninth stage Q9 of the shift register 70 corresponding to the minor third (3♭) is selected through the AND gate 88. The AND gate 90 is disabled at this time and the output of the eighth stage Q8 corresponding to the major third (3°) therefore is inhibited. If the chord is not a minor chord, the data min is "0" and the output of the eighth stage Q8 corresponding to the major third (3°) is selected through the AND gate 90 whereas the output corresponding to the minor third (3♭) is inhibited by the AND gate 88.

AND gates 91 and 93 are provided for selecting either the minor seventh (7♭) in accordance with the seventh chord data 7th. The data 7th is "1" in a seventh chord and the output of the stage Q2 corresponding to the minor seventh (7♭) is selected through the AND gate 91 whereas the output corresponding to the perfect fifth (5°) is inhibited by the AND gate 93. Conversely, if the chord is not a seventh chord, the output of the fifth stage Q5 corresponding to the perfect fifth (5°) is selected through the AND gate 93 whereas the output corresponding to the minor seventh (7♭) is inhibited by the AND gate 91.

The outputs of the AND gaes 88, 90, 91 and 93 are multiplexed by an OR gate 94 and are outputted therefrom as the chord key data CKD.

The output of the OR gate 69 corresponding to the root note (1°) is applied unconditionally to the OR gate 94 and is outputted therefrom as the chord key data CKD. In the example shown in FIG. 6, if both the minor chord data min and the seventh chord data 7th are "0", the chord keydata CKD is turned to "1" at note timings of notes C, G, and E. These notes C, G and E constitute a C major chord.

AND gates 95 and 96 and OR gate 97 are provided for producing bass tone key data BKD. The AND gate 95 receives a prime bass tone sounding timing signal BT1 provided by the automatic accompaniment tone sounding timing signal generation circuit 14 (FIG. 1) and a signal representing a note timing of the root note (1″) provided by the OR gate 69. The AND gate 96 receives a fifth bass tone sounding timing signal BT5 and a signal representing a note timing of the fifth (5°) outputted by the stage Q5 of the shift register 70. If a tone of the same note as the root note of the chord i.e., the prime (1°) is to be sounded as the bass tone, the signal BT1 maintains "1" continuously in accordance with the time during which sounding is to be continued and the output of the AND gate 95 is repeatedly turned to "1" in response to the note timing of the root note. If a tone of a note which is separated from the root note of the chord by five degrees, i.e., the fifth (5°) is to be sounded as a bass tone, the signal BT5 maintains "1" continuously in accordance with the sounding time and the output of the AND gate 96 is repeatedly turned to "1" at a note timing of the note which is separated from the root note by five degrees. The outputs of the AND gates 95 and 96 are outputted as the bass tone key data BKD through the OR gate 97.

The chord key data CKD and the bass tone key data BKD are applied to AND gates 98 and 99 of the key data distribution circuit 17 (FIG. 1). The AND gate 98 receives at the other input thereof the chord sounding timing signal CT and the signal SF outputted from the single finger mode selection switch SF-SW. Accordingly, the chord key data CKD provided by the chord detection unit 13 is selected by the AND gate 98 only as a chord tone sounding timing (i.e., when the signal CT is "1") in the single finger mode (i.e., when the signal SF is "1"). The chord key data CKD' which has been selected by the AND gate 98 is applied to the key assigner circuit 12. A plurality of notes corresponding to this chord key data CKD' are assigned to suitable channels in the circuit 12. Musical tones are formed on the basis of these notes in the tone forming circuit 15 with the tone color of the chord being provided and the tones are sounded simultaneously. In the above described manner, the chord (i.e., chord constituting tones) determined by the root note and the chord type designated by depression of keys in accompaniment key range in the keyboard 10 is automatically and simultaneously sounded at the chord sounded timing.

The AND gate 99 receives at the other input thereof the single finger mode signal SF and the bass tone sounding timing signal BT provided by an OR gate 100. The OR gate 100 in turn receives the prime bass tone sounding timing signal BT1 and the fifth bass tone sounding timing signal BT5 so that the bass tone sounding timing signal BT is turned to "1" at either the prime or fifth sounding timing (i.e., at any bass tone sounding timing). Accordingly, the bass tone key data BKD outputted by the chord detecting unit 13 is selected by the AND gate 99 at a bass tone sounding timing in the single finger mode. Bass tone key data BKD' selectively outputted by the AND gate 99 is applied to the key assigner circuit 12 and, in accordance with the assignment operation performed by the key assigner circuit 12, bass tones corresponding to notes of the key data BKD, are produced in the tone forming circuit 15.

Reverting to FIG. 4 again, an operation in case the root note designation key has been changed in a legato style will be described.

Figure 7:
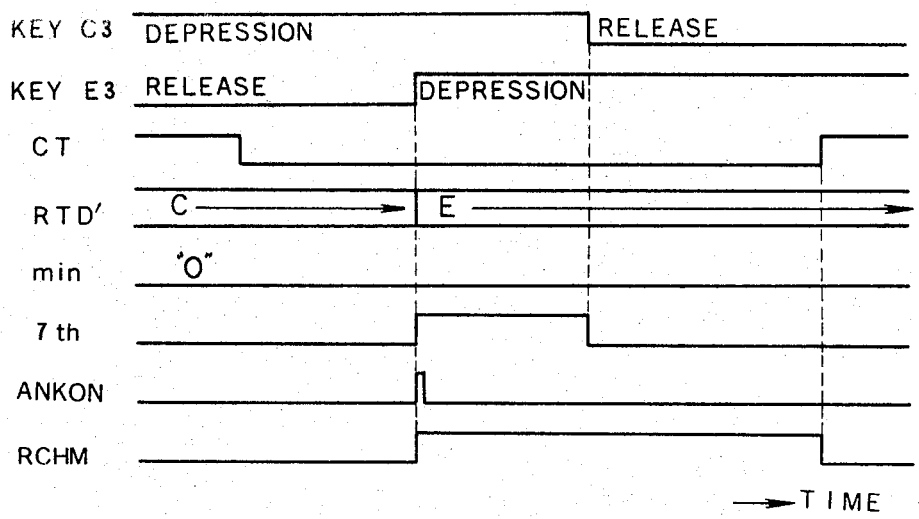
FIGS. 7 and 8 are time charts showing generally an example of the operation of the circuit shown in FIG. 4 in a case wherein a root note designating key is changed in a legato style.

With reference first to FIG. 7 or a case where the root note designation key has been changed in a legato style from a low note (e.g. key C3) to a high note (e.g. key E3) will be described. FIG. 7 generally shows key depression timings for the keys C3 and E3 and time relations between signals CT, RTD', min, 7th ANKON and RCHM. Time during which an old root note designation key (e.g. key C3) and a new root note designation key (e.g. key E3) are simultaneously depressed is a brief one corresponding to a few scanning cycles to several tons of scanning cycles. Before the new root note designation key E3 is stored the root note memory data RTD' corresponding to the note timing of the note C and the minor chord data min and the seventh chord data 7th stored in the chord type memory 44 are both "0" (i.e., designating a major chord). If the new root note designation key E3 is depressed before the old root note designation key C3 is released, the accompaniment key range key data LKD is turned to "1" both at the timings of the keys C3 and E3 whereby the signal "1" corresponding to the higher key E3 is selected by the AND gate 54 as the root note data RTD whereas the signal "1" corresponding to the lower key C3 is selected by the AND gate 57 as the chord type designation key data CKKD. As a result, the root note memory data RTD' stored in the root note memory 43 is rewritten to data corresponding to note E almost simultaneously with start of depression of the root note designation key E3. In the meanwhile, since the key C3 selected as the chord type designation key data CKKD is a white key, the seventh chord detection signal 7D outputted by the chord type temporary memory 42 is turned temporarily to "1". The seventh chord detection signal 7D which is "1" is loaded in the chord type memory 44 in response to the any new key-on signal ANKON which is generated upon starting of depression of the new root note designation key E3 and the seventh chord data 7th thereby is turned to "1". Further, since the root note memory 43 still stores "1" at a tone timing of the note C which is the old root note when the root note data RTD is first turned to "1" at the timing of the key E3 upon starting of depression of the new root note designation key E3, the AND gate 82 of the root note cange memory 48 is enabled so that the root note change memory signal RCHM rises to "1". Accordingly, the data stored in the chord type memory 44 is rewritten every scanning cycle. However, the seventh data 7th outputted by the chord type memory 44 remains "1" until depression of the old root note designation key C3 is released. Upon release of the old root note designation key C3, the signal mD and 7D outputted by the chord type temporary memory 42 are both turned to "0" and the data min and 7th stored in the chord type memory 44 are both rewritten to "0". This is because the root note change memory signal RCHM outputted by the root note change memory 48 still is "1". Upon subsequent rising of the chord sounding timing signal CT to "1", the root note change memory 48 is cleared and the root note change memory signal RCHM thereby is turned to "0". This causes the chord type memory 44 to cease rewriting and, accordingly, the memory 44 holds storage of the data indicating correct chord type (i.e., data min and 7th being both "0") which has been loaded before the rising of the signal CT.

As described above, in the case where the root note designation key changes from a low note to a high note in a legato style, data RTD' which represents a new root note is immediately stored in the root note memory 43. Data min and 7th representing false chord type are temporarily stored in the chord type memory 44 until the old root note designation key has been released. There occurs no inconvenience, however, for no chord is sounded in accordance with such false chord types because the chord sounding timing has not arrived yet. Upon release of the old root note designation key, data min and 7th representing correct chord types are immediately stored in the chord type memory 44 so that the contents stored in the root note memory 43 and the chord type memory 44 are correct ones when the chord sounding timing has arrived and a deisred chord is accurately sounded.

Nextly, a case wherein the root note designation key has been changed from a high note (e.g., a key C3) to a low note (e.g. a key G2) in a legato style will be described with reference to FIG. 8.

Figure 8:
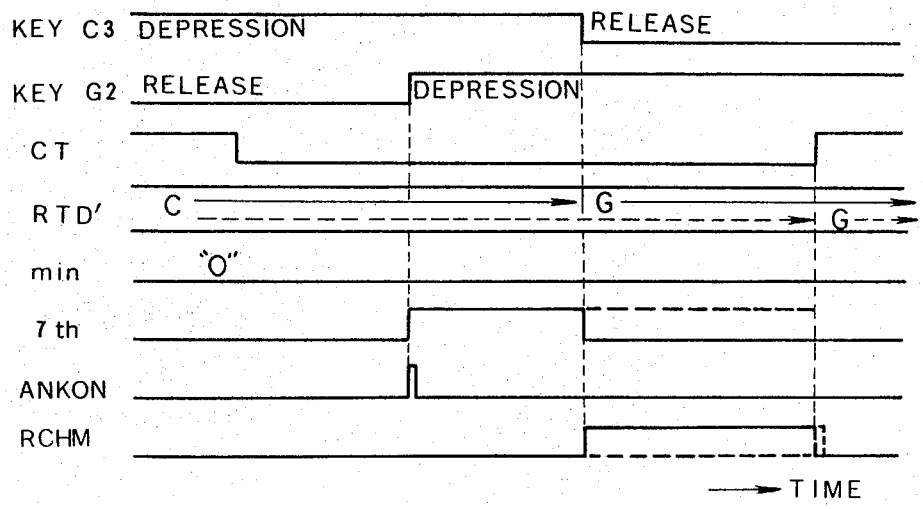

FIG. 8, like FIG. 7, generally shows time relations between various signals. Since a new root note designation key G2 is on a lower note side from an old root note designation key C3, the old root note designation key C3 is detected as the root note data RTD until the old root note designation key C3 is released and the storage in the root note memory 43 is not rewritten. When the any new key-on signal ANKON is generated in response to the new root note designation key G2, the old and new root note designation keys C3 and G2 are still being depressed simultaneously. The key on the lower note side therefore is G2 which is a white key and the seventh chord detection signal 7D which is "1" is loaded in the chord type memory 44. Upon release of the old root note designation key C3, the new root note designation key G2 is detected as the root note data RTD and the data RTD' stored in the root note memory 43 is changed to note G whereas the change in the root note is stored in the root note change memory 48. The chord type designation key is brought into a state wherein no key is being depressed at all and the signal mD and 7D outputted from the chord type temporary memory 42 are both turned to "0". These signals mD and 7D representing correct chord types are loaded in the chord type memory 44 in response to the root note change memory signal RCHM.

As described above, in the case where the root note designation key has been changed from a high tone to a low tone in a legato style, the data RTD' representing the old root note is stored in the root note memory 43 and the data min and 7th representing false chord types are stored in the chord type memory 44 until the old root note designation key is released whereas upon release of the old root note designation key, the data RTD' stored in the root note memory 43 is immediately rewritten to data representing the new root note and the data min and 7th stored in the chord type memory 44 are rewritten to data representing a correct chord type in response to the root note change memory signal RCHM. Accordingly, when the chord sounding timing has subsequently arrived, the data stored in the root note memory 43 and the chord type memory 44 have become correct data thereby enabling accurate sounding of a desired chord.

If a major chord is designated by depressing a root note designation key only, there arises no particular problem. If, however, a minor chord or a seventh chord is designated by depressing two or more keys (i.e., a root note designation key and a chord type designation key), there will arise the following problem if the output (RTD) of the AND gate 54 is directly applied to the root note memory 43 and the root note change memory 48 without providing the new key-on memory 47 and the AND gate 55. In a case when two or more keys are released at the same time, they are hardly released simultaneously in a strict sense of the word but, as viewed microscopically, there is difference between timings of release of these keys. Due to this difference, release of the respective keys is not detected in the same scanning cycle but in different scanning cycles. If release of the root note designation key is first detected, the remaining chord type designation key becomes the highest depressed key and false root note data (RTD) is temporarily outputted from the AND gate 54. If this false root note data (RTD) is applied to the root note memory 43 and the root note change memory 48, the data RTD' stored in the root note memory 43 is rewritten to data representing a false note and a root note change is loaded in the root note change memory 48 with a result that data representing a false chord type is stored in the chord type memory 44. For eliminating such inconvenience, the new key-off memory 47 and the AND gate 55 are provided such that the AND gate 55 is disabled when the new key-off memory 47 has detected the fact that any key has newly been released so as to prevent generation of the root note data RTD.

An AND gate 101 in the new key-off memory 47 receives the accompaniment key range key data LKD* in a preceding scanning cycle provided by the key data memory 45, a signal $\overline{LKD}$ which is obtained by inverting the accompaniment key range key data LKD in the present scanning cycle by an inverter 102 and the accompaniment key range scanning timing signal LKT. If, with regard to the key data LKD in the accompaniment key range (i.e., the signal $\overline{LKT}$ is "1"), contents of the key data LKD are those representing release of the key (i.e., LKD is "1") in the present scanning cycle whereas they are those representing that the key is being depressed (i.e., LKD* is "1") in the preceding scanning cycle, this signifies that the key corresponding to the key data LKD has newly been released so that the AND gate 101 is enabled. The output of the AND gate 101 is applied to a delay flip-flop 104 through an OR gate 103 and self-held therein through an AND gate 105. The output of the delay flip-flop 104 is applied to the inverter 56 as an any inverted output of the inverter 56 is applied to the other input of the AND gate 55. Accordingly, upon release of any new key in the accompaniment key range, the any new key-off signal ANKOF maintains a state "1" continuously and the AND gate 55 is disabled by the output "0" of the inverter 56 which inverts the signal ANKOF.

The AND gate 105 receives at the other input thereof an output of a NAND gate 106. The NAND gate 106 receives the first block timing signal BTO (FIG. 3) and the chord sounding timing signal CT or bass tone sounding timing signal BT provided through an OR gate 107. When the chord sounding timing signal CT or bass tone sounding timing signal BT is turned to "1", the output of the NAND gate 106 is turned to "0" at the block timing TO (i.e., signal BTO is "1") in each scanning cycle and the AND gate 105 thereby is disabled. Accordingly, the any new key-off signal ANKOF maintains a state "1" continuously from the time when any key has newly been released in the accompaniment key range till arival of the chord sounding timing or bass tone sounding timing. The false root note data (RTD) which is generated temporarily due to difference in timing of releasing of keys is inhibited without fail by the AND gate 55 in accordance with the any new key-off signal ANKOF.

By controlling the root note data (RTD) by the output ANKOF of the new key-off memory 47, the root note data RTD corresponding to the new root note designation key is not immediately obtained upon release of the old root note designation key in a case where the root note designation key has been changed from a high key (e.g. C3) to a low key (G2) in a legato style. This is because the root note data (RTD) corresponding to the new root note designation key is outputted from the AND gate 54 upon rising of the any new key-off signal ANKOF to "1" by detection of the release of the old root note designation key and this new root note data (RTD) is inhibited by the AND gate 55. Upon arrival of the chord or bass tone sounding timing (i.e., the signal CT or BT is turned to "1"), however, the any new key-off ANKOF falls immediately to "0" and, accordingly, the correct root note data RTD' is stored in the root note memory 43 and the root note change is stored in the root note change memory 48 in the first scanning cycle upon arrival of the chord or bass tone sounding timing. Although the root note change memory 48 is cleared at the block timing TO in the next scanning cycle, the root note change memory signal RCHM remains "1" until the first key time of the block timing TO and at this time a signal "1" is applied to the load input (LD) of the chord type memory 44 from the AND gate 67 and correct chord type data is stored in the chord type memory 44. Accordingly, in the circuit shown in FIG. 4, the data RTD', 7th and RCHM actually change at a timing shown by a broken line in case of the example shown in FIG. 8. Since, however, correct data is accurately stored in the root note memory 43 and the chord type memory 44 at the chord or base tone sounding timing, a desired chord can be accurately sounded.

In a case where the root note designation is changed from a low note (e.g. C3) to a high note (e.g. E3) in a legato style, the above described problem does not take place. This is because the root note data (RTD) corresponding to the new root note designation key (E3) is turned to "1" in immediate response to depression of the key (E3) and the new root data (RTD) is gated out of the AND gate 55.

The root note change memory 48 and the new key-off memory 47 are so constructed that these memories continuously store the root note change memory signal RCHM or the any new key-off signal ANKOF during a proper waiting time from detection of the root note change or new key-off. This waiting time is set to time until arrival of the chord or bass tone sounding timing and not a constant interval of time for preventing occurrence of inconvenience in the sounding of the automatic accompaniment tone. If the waiting time is set to a constant interval of time, the stored contents of the root note or chord type may change during sounding of the automatic accompaniment tones with a result that the automatic accompaniment tones may change during sounding. No such inconvenience will take place in the embodiment of the present invention. The new key-off memory 47 is controlled by both the chord sounding timing signal CT and the bass tone sounding timing signal BT whereas the root note change memory 48 is controlled by the chord sounding timing signal CT only. This is because the bass tone used in this embodiment are the prime and the fifth which relate to a root note but not to a chord. The output RCHM of the root note change memory 48 is used for controlling storage in the chord type memory 44 and the outputs min and 7th of the memory 44 are not used for forming of the bass tone key data BKD. Accordingly, it is not necessary to use the bass tone timing signal BT for controlling storage in the root note change memory 48. In other words, no inconvenience arises in the present embodiment by change in the storage in the chord type memory 44, during sounding of the bass tone. In a case where the degree of notes to be sounded as a bass tone increases and selection as to whether a bass tone sounded e.g. as the third should be minor one or a major one is to be made depending upon the chord type, control of storage in the root note change memory 48 should be made by both the chord sounding timing signal CT and the bass tone sounding timing signal BT as in the new key-off memory 47.

Figure 9:
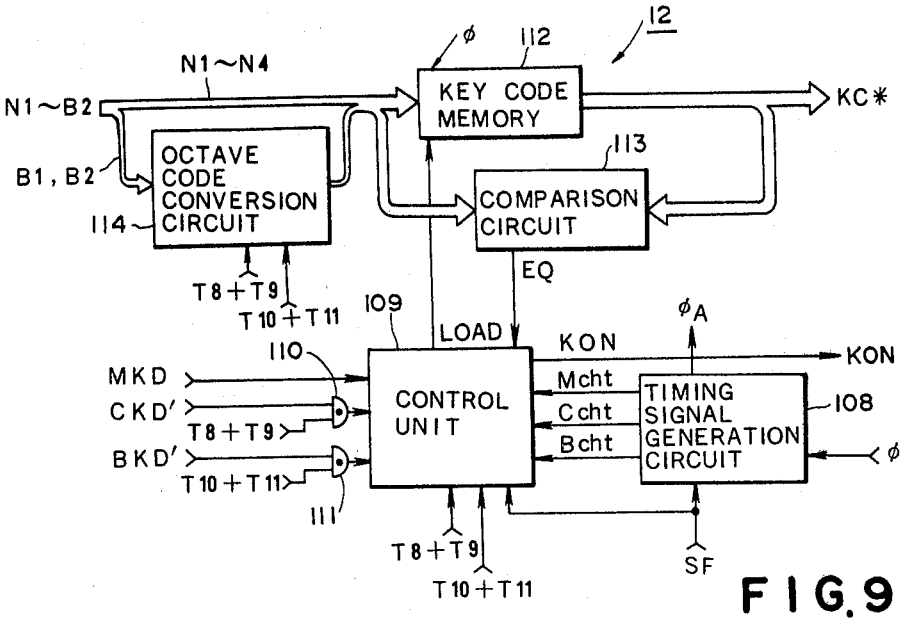
FIG. 9 is a block diagram showing an example of a key assigner shown in FIG. 1.

Referring to FIG. 9, an example of the key assigner circuit 9, an example of the key assigner circuit 12 will be described.

Figure 10:
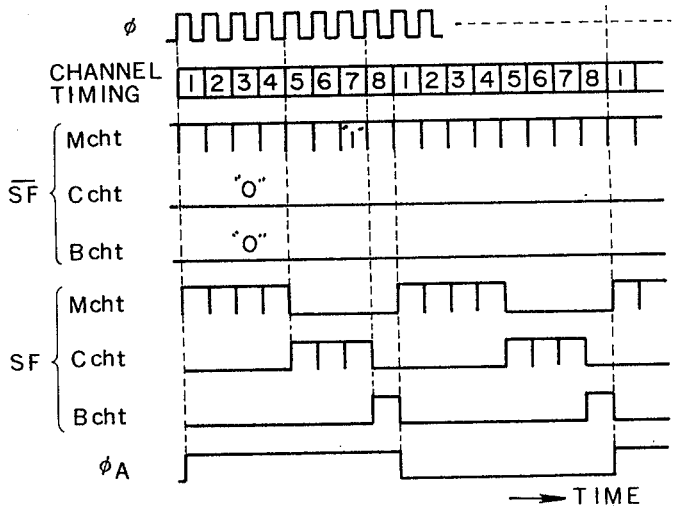
FIG. 10 is a time chart showing an example of generation of timing signals in the circuit shown in FIG. 9.

A timing signal generation circuit 108 generates a melody channel timing signal MchT, a chord channel timing signal CchT, a bass channel timing signal BchT and a scanning clock pulse $\phi_A$ in response to the master clock pulse $\phi$ and the single finger mode signal SF. In the key assigner circuit 12, timings corresponding to the respective channels CH1–CH8 are formed on a time shared basis in accordance with the master clock pulse $\phi$. Relationship between the master clock pulse $\phi$ and the timings of the respective channels CH1–CH8 is shown in FIG. 10. Digits 1 through 8 in the column of the channel timings in FIG. 10 correspond to the channels CH1 through CH8. The timing signal generation circuit 108 generates the respective channel timing signals MchT, CchT and BchT as shown in FIG. 10 in accordance with a state of the single finger mode signal SF ("1" or "0"). Reference characters $\overline{SF}$ represents a state "0" of the signal SF and SF a state "1" of the signal SF. Utilization of channels as shown in the Table 1 thereby is realized. The timing signal generation circuit 108 generates also the scanning clock pulse $\phi_A$ as shown in FIG. 10 in synchronism with repeating of the channel timing. One cycle of the scanning clock pulse $\phi_A$ corresponds to two cycles of the channel timing.

The respective channel timing signals MchT, CchT and BchT and applied to key assigning control unit 109. The control unit 109 receives also the melody key data MKD, the chord key data CKD' and the bass tone key data BKD' provided by the key data distribution circuit 17 (FIG. 1). The chord key data CKD' is selected through an AND gate 110 at block timings T8 and T9 (totalling 12 key times) by a timing signal T8+T9 (FIG. 3) and thereafter is applied to the control unit 109. The bass tone key data BKD' is selected through an AND gate 111 at block timings T10 and T11 (totalling 12 key times) by a timing signal T10+T11 (FIG. 3) thereafter is applied to the control unit 109. In the control unit 109, note of the depressed key represented by the melody key data MKD is assigned to any one of the channels indicated by the melody channel timing signal MchT, the notes constituting the chord represented by the chord key data CKD' are assigned to any of the channels indicated by the chord channel timing signal CchT and the bass tone represented by the bass tone key data BKD' is assigned to the channel indicated by the bass channel timing signal BchT.

A key code memory 112 stores key codes KC* representing depressed key (or notes) assigned to the respective channels on a time shared basis in synchronism with the respective channel timings and outputs these key codes KC* on a time shared basis in synchronism with the respective channel timings. The note code portion N1–N4 in the key code N1–B2 outputted by the depressed key detection circuit 11 (FIG. 2) is supplied directly to the key code memory 112 and a comparison circuit 113 and the octave code portion B1, B2 is supplied to the key code memory 112 and a comparison circuit 113 through an octave code conversion circuit 114. To the octave code conversion circuit 114 are applied the timing signals T8+T9 and T10+T11 and values of the octave codes B1, B2 provided at timings of these signals i.e., at block timings T8–T11, are converted to predetermined values whereas the octave codes provided at other timings are outputted without conversion.

The comparison circuit 113 compares the key code N1–B2 provided by the depressed key detection circuit 11 and representing a key which is presently being scanned with the key code KC* stored in the key code memory 112 and having been assigned to the respective channels and produces a coincidence signal E2 when these key codes coincide with each other. The key code N1–B2 provided by the depressed key detection circuit 11 maintains the same value during one cycle of the scanning clock pulse $\phi_A$ during which the channel timing circulates two cycles (FIG. 10).

The key assigning control unit 109 comprises a key-on memory (not shown) which stores a key-on signal KON indicating whether the key data MKD, CKD' and BKD' corresponding to the notes having been assinged to the respective channels still represent a state of a depressed key (i.e. "1"). Key-on signals KON of the respective channels therefore are outputted on a time shared basis in synchronism with each channel timing. Upon judging that a note corresponding to the key data (MKD or CKD' or BKD') which is presently applied should be assigned to some channel, the key assigning control unit 109 supplies a load signal LOAD to the key code memory 112 in synchronism with the channel timing of the channel to cause the memory 112 to store the key code N1–B2 then being applied thereto in synchronism with the channel timing. Simultaneously, contents of the key-on signal KON corresponding to this channel are turned to "1".

In a case where the single finger mode has not been selected (i.e., in the case of $\overline{SF}$), the melody channel timing signal McHT is turned to "1" for all of the channel timings as shown in FIG. 10 and the other signals CchT and BchT are not generated at all. The AND gate 38 in the key data distribution circuit 17 (FIG. 1) thereupon is enabled and the key data KD for all keys C6–F2 becomes the melody key data MKD. The key code N1–B2 provided by the depressed key detection circuit 11 represents a key to which the key data MKD being presently applied corresponds. Since generation of the coincidence signal EQ from the comparison circuit 113 signifies that the key data MKD being presently applied has already been assigned to some channel, no new assignment is performed. If the key data MKD is "1" and no coincidence signal EQ corresponding to the key data MKD is generated, the key assigning control unit 109 produces the load signal LOAD in synchronism with one of channel timings for empty channels (including a channel to which no key has been assigned at all or a channel in which an assigned key has already been released) among channel timings at which the channel timing signal MchT is generated. In the above described manner, the key depressed for performance of melody is assigned to one of the melody channels.

In a case where the single finger mode has been selected, the channel timing signals MchT, CchT and BchT are generated at their respective channel timings as shown in the column of SF in FIG. 10. The AND gate 38 in the key data distribution circuit 17 (FIG. 1) thereupon is disabled with a result that the AND gates 98 and 99 are disabled. Consequently, key data (UKD) for preset high key range keys (C6–CCG3) only is selected as the melody key data MKD. Assignment of the melody key data is performed in the same manner as descirbed above except that the key data MKD is limited to the keys C6 through G3 and that channel timings at which the channel timing signal MchT is generated are limited to the channels CH1 through CH4. In the above described manner, the key depressed for performance of melody is assigned to any one of the melody channels CH1–CH4.

The assignment concerning the chord key data CKD' is performed at the block timings T8 and T9 (FIG. 3) at which the timing signal T8+T9 is generated. Since the block timings T8 and T9 have duration of time equivalent to 12 key times, the chord key data CKD' corresponding to 12 notes (C, B . . . C#) are all produced. The octave conversion circuit 114 converts the octave code B1, B2 applied when the timing signal T8+T9 is "1" to a value representing a preset octave range for performing a chord. Accordingly, at the block timings T8 and T9, the key code for performing the chord consisting of the note code N1–N4 provided by the depressed key detection circuit 11 and the octave code (B1, B2) converted by the octave code convertion circuit 114 is applied to the key code memory 112 and the comparison circuit 113. If, when the chord key data CKD' applied at the block timings T8 and T9 is "1", the coincidence signal EQ is not generated in accordance with the key data (i.e., no assignment has been made yet), the key assigning control unit 109 generates the load signal LOAd in synchronism with one of empty channels among channels at which the chord channel timing signal CchT is generated. In response to this load signal LOAD, the key code for the chord performance (the note code N1–N4 thereof corresponding to the note of the then existing key data CKD' are the octave code B1, B2 representing a preset octave for the chord) is stored in the key code memory 112. In the above described manner, the notes constituting the chord are assigned to the chord channels CH5, CH6 and CH7 respectively.

The assignment concerning the base tone key data BKD' is performed at block timings T10 and T11 (FIG. 3) during which a timing signal T10+T11 is generated. Since the block timing T10 and T11 have duration of time equivalent to 12 key times, the bass tone key data BKD' corresponding to 12 notes (C, B . . . C#) are all outputted during these timings. The octave code conversion circuit 114 converts the octave code B1, B2 applied when the timing signal T10+T11 is "1" to a value representing a preset octave range for performing the bass tone. Accordingly, at the block timings T10 and T11, the bass tone key code consisting of the note code N1–N4 provided by the depressed key detection circuit 11 and the octave code (B1, B2) which has been converted by the octave code conversion circuit 114 is applied to the key code memory 112 and the comparison circuit 113. When the bass tone key data BKD' applied at the block timings T10 and T11 is "1", the key assigning control unit 109 generates the load signal LOAD in synchronism with the timing of the channel CH8 at which the bass channel timing signal BchT is generated and the key code corresponding to this key data BKD' (having the note code N1–N4 corresponding to the then existing note timing and the octave code representing a preset octave for performance of the bass tone) is stored in the key code memory 112. In this manner, the bass tone is assigned to the bass tone channel CH8.

The chord constituting tones may be sounded not only according to the chord sounding timing but according to an arpeggio sounding timing in the form of a broken chord. In that case, the storage control signals used in the root note change memory 48 and the new key-off memory 47 in FIG. 4 include not only the chord sounding timing signal CT and the bass tone sounding timing signal BF but also a signal representing an arpeggio sounding timing.

In the above described embodiment, a part of the keyboard is used as the accompaniment key range and the root note and the chord type are designated by depression of keys in this accompaniment key range. Alternatively, the entire keyboard or one stage (e.g. a lower keyboard) of a keyboard consisting of a plurality of keyboards may be used for designating the root note and the chord type. In the above described embodiment, the chord type is distinguished depending upon whether a white key or black key is depressed. Alternatively, the chord type may be distinguished by the number of depressed keys.

What is claimed is:

1. A chord generating apparatus of an electronic musical instrument comprising:

a plurality of keys;

a plurality of key switches provided for said plurality of keys respectively;

root note detecting means for selecting a single key among one or more of the depressed keys according to predetermined condition to detect the selected key as a root note designation key;

chord type detecting means for detecting a chord type according to the state of the depressed keys other than the selected root note designation key;

root note memory means for storing root note data which is rewritten in response to change in the root note designation key;

chord type memory means for storing chord type data detected by said chord type detecting means;

new key detecting means for detecting depression of a new key in response to the output of said key switches to provide a new key detection signal upon detection of the new key;

root note change detecting means for detecting change in a root note in response to the outputs of said root note detecting means and said root note memory means to provide a root note change signal during a waiting time in response to detection of the change in the root note;

control means for controlling loading of the chord type data to said chord type memory means in response to the outputs of said new key detecting means and said root note change detecting means; and tone generating means for generating tones relating to a chord detection by the root note stored in said root note memory means and the chord type stored in said chord type memory means.

2. A chord generating apparatus as defined in claim 1 wherein said control means causes the chord type data to be loaded in said chord type memory means in response to either one of the new key detection signal outputted by said new key detecting means and the root note change signal outputted by said root note change detecting means.

3. A chord generating apparatus as defined in claim 1 wherein said root note change detecting means comprises comparator means for comparing the root note detected by said root note detecting means with the root note stored in said root note memory means to detect change in the root note, a memory circuit for storing and outputting the root note change signal in accordance with detection of the change in the root note for said comparator means and clear means for setting said waiting time by clearing said memory circuit in response to a predetermined timing signal.

4. A chord generating apparatus as defined in claim 3 which further comprises:

scanning means for successively scanning said key switches according to an order of array of said keys; and means for forming time division multiplex key data according to depressed states of the keys corresponding to the key switches scanning by said scanning means;

and wherein said root note detecting means comprises a priority circuit which selects data representing depression of a key which appears first as said time division multiplexed key data in a predetermined scanning period by said scanning means and detects, as the root note designation key, a key relating to a scanning timing corresponding to timing of generation of said selected data;

said root note memory means comprises a circulating shift register which stores the detected data representing the scanning timing of the root note designation key by shifting the data selected by said priority circuit in synchronism with the scanning by said scanning means; and said comparator means comprises a logic circuit which compares timing of the root note data outputted by said priority circuit with timing of the root note data outputted by said shift register to detect change in the root note when the two data do not coincide with each other.

5. A chord generating apparatus as defined in claim 3 which further comprises accompaniment tone sounding timing signal generating means for generating a signal representing a sounding timing of an automatic accompaniment tone and wherein;

said tone generating means generates the automatic accompaniment tone relating to the chord determined by the root note stored in said root note memory means and the chord type stored in said chord type memory means in response to the accompaniment tone sounding timing signal; and said clear means provides, as said waiting time, a time interval from detection of the change in the root note by said comparator means till arrival of a next sounding timing of the automatic accompaniment tone by clearing said memory circuit by the accompaniment tone sounding timing signal.

6. A chord generating apparatus as defined in claim 1 which further comprises:

new key-off detecting means for detecting a new release of a key in response to the output of said key switches so as to produce a new key-off signal during a second waiting time in accordance with the detection of a new release of a key; and prohibiting means responsive to said new key-off signal for prohibiting detection of the change in the root note by said root note change detecting means and also prohibiting change in storage of said root note memory means.

7. A chord generating apparatus as defined in claim 6 wherein said new key-off detecting means comprises:

means for detecting the new release of a key in response to the outputs of said key switches;

a new key-off memory circuit which stores and outputs the new-key off signal upon detection of the new release of a key; and a clear circuit which provides the second waiting time by clearing said new key-off memory circuit by a predetermined timing signal;

and wherein said prohibiting means prohibits detection of the change in the root note and the change in the storage of the root note by prohibiting the output of said root note detecting means by said new key-off signal.

8. A chord generating apparatus as defined in claim 7 which further comprises accompaniment tone sounding timing signal generating means for generating a signal representing a sounding timing of an automatic accompaniment tone and wherein;

said tone generating means generates the automatic accompaniment tone relating to the chord determined by the root note stored in said root note memory means and the chord type stored in said chord type memory means in response to the accompaniment tone sounding timing signal; and said clear circuit provides, as said second waiting time, a time interval from detection of the new release of a key till arrival of a next sounding timing of the automatic accompaniment tone by clearing said new key-off memory circuit by the accompaniment tone sounding timing signal.

9. A chord generating means as defined in claim 1 wherein said root note memory means comprises a register for storing the root note data and a control circuit for controlling storage of the root note data in said register when the root note stored in said register and the root note detected by said root note detecting means do not coincide with each other.

10. A chord generating means as defined in claim 1 wherein said root note detecting means selects the highest key or the lowest key among the depressed keys and detects this highest or lowest key as the root note designation key and said chord type detecting means determines the chord type depending upon whether or not sharp keys or natural keys are being depressed besides said root note designation key.

11. A chord generating apparatus as defined in claim 10 which further comprises:

scanning means for successively scanning said key switches according to an order of array of said keys;

means for forming time division multiplex key data according to depressed states of keys corresponding to the key switches scanned by said scanning means; and means for selecting time division multiplex key data of an accompaniment key group from among said time division multiplex key data; and wherein said keys are divided into said accompaniment key group and a melody key group;

said root note detecting means comprises a priority circuit which selects data representing depression of a key which appears first in the time division multiplex key data of the accompaniment key group and detects a key relating to a scanning timing corresponding to the timing of generation of said selected data as the root note designation key;

said chord type detecting means comprises means for obtaining data representing states of depression of keys other than the root note designation key in said accompaniment key group by excluding said selected data in said priority circuit from the time division multiplex key data of the accompaniment key group, means for judging whether sharp keys or natural keys are being depressed depending upon the data representing the states of depression of the keys other than the root note designation key and means for temporarily storing and outputting the chod type data in response to this judgement; and said new key detecting means comprises a key data memory storing key data of the accompaniment key group, comparator means for comparing the output of said key data memory with next key data to detect depression of a new key and means for outputting a new key detection signal in response to the output of said comparator means.

* * * * *

UNITED STATES PATENT AND TRADEMARK OFFICE

CERTIFICATE OF CORRECTION

PATENT NO. : 4,381,689

DATED : May 3, 1983

INVENTOR(S) : Akiyoshi Oya

It is certified that error appears in the above–identified patent and that said Letters Patent are hereby corrected as shown below:

Column 7, line 27, after ""3"," insert --"4"--.

Column 7, line 28, after "outputs" insert --"0",--.

Column 8, line 53, change "T10 and T11" to --T10+T11--.

Column 14, line 17, change "LTD*" to --LKD*--.

Column 14, line 19, change "LD*" to --LKD*--.

Column 18, line 19, after "($7^b$)" insert --or the perfect fifth (5°)--.

Column 27, line 38, change "detection" to --determined--.

Signed and Sealed this

*Twenty-sixth* Day of *June 1984*

[SEAL]

*Attest:*

GERALD J. MOSSINGHOFF

*Attesting Officer*

*Commissioner of Patents and Trademarks*